US010172387B2

(12) United States Patent
Davis et al.

(10) Patent No.: US 10,172,387 B2
(45) Date of Patent: Jan. 8, 2019

(54) CARBON CONDUCTIVE SUBSTRATE FOR ELECTRONIC SMOKING ARTICLE

(71) Applicant: R.J. REYNOLDS TOBACCO COMPANY, Winston-Salem, NC (US)

(72) Inventors: Michael F. Davis, Clemmons, NC (US); Balager Ademe, Winston-Salem, NC (US); Chandra Kumar Banerjee, Clemmons, NC (US); Susan K. Pike, Pilot Mountain, NC (US); David William Griffith, Jr., Winstom-Salem, NC (US); Stephen Benson Sears, Siler City, NC (US); Evon L. Crooks, Mocksville, NC (US); Karen V. Williams, Cary, NC (US); Timothy Brian Nestor, Advance, NC (US); David Bovender, Walnut Cove, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 1415 days.

(21) Appl. No.: 14/011,992

(22) Filed: Aug. 28, 2013

(65) Prior Publication Data

US 2015/0059780 A1 Mar. 5, 2015

(51) Int. Cl.
*A24F 47/00* (2006.01)

(52) U.S. Cl.
CPC ..... *A24F 47/008* (2013.01)

(58) Field of Classification Search
CPC ..... A24F 47/008; A61M 15/06; H05B 3/143; C04B 38/0054
USPC ..... 131/329; 392/386
See application file for complete search history.

(56) References Cited

U.S. PATENT DOCUMENTS

| | | | |
|---|---|---|---|
| 1,771,366 | A | 7/1930 | Wyss et al. |
| 2,057,353 | A | 10/1936 | Whittemore, Jr. |
| 2,104,266 | A | 1/1938 | McCormick |
| 2,805,669 | A | 9/1957 | Meriro |
| 3,200,819 | A | 8/1965 | Gilbert |
| 3,316,919 | A | 5/1967 | Green et al. |
| 3,398,754 | A | 8/1968 | Tughan |

(Continued)

FOREIGN PATENT DOCUMENTS

| | | |
|---|---|---|
| AU | 276250 | 7/1965 |
| CA | 2 641 869 | 5/2010 |

(Continued)

*Primary Examiner* — Joseph S Del Sole
*Assistant Examiner* — Mohamed K Ahmed Ali
(74) *Attorney, Agent, or Firm* — Womble Bond Dickinson (US) LLP

(57) ABSTRACT

The present disclosure provides components useful in heating, particularly heating of an aerosol precursor solution so as to vaporize the solution and form an aerosol. The disclosure particularly provides an electrically conductive, porous carbon heater. The heater may be combined with an aerosol precursor transport element that also is formed of carbon. The heater and transport element may form an atomizer that can be useful in an electronic smoking article, such as in a cartridge that is adapted for attachment to a control body. In some embodiments, the disclosure provides a cartridge of an electronic smoking article, the cartridge being formed substantially completely of carbon.

19 Claims, 12 Drawing Sheets

(56) References Cited

U.S. PATENT DOCUMENTS 3,419,015 A 12/1968 Wochnowski
3,424,171 A 1/1969 Rooker
3,476,118 A 11/1969 Luttich
4,054,145 A 10/1977 Berndt et al.
4,106,891 A * 8/1978 Schladitz ..... H05B 3/10 392/396
4,131,117 A 12/1978 Kite et al.
4,150,677 A 4/1979 Osborne
4,190,046 A 2/1980 Virag
4,219,032 A 8/1980 Tabatznik et al.
4,259,970 A 4/1981 Green, Jr.
4,284,089 A 8/1981 Ray
4,303,083 A 12/1981 Burruss, Jr.
4,449,541 A 5/1984 Mays et al.
4,506,682 A 3/1985 Muller
4,635,651 A 1/1987 Jacobs
4,674,519 A 6/1987 Keritsis et al.
4,708,151 A 11/1987 Shelar
4,714,082 A 12/1987 Banerjee et al.
4,735,217 A 4/1988 Gerth et al.
4,756,318 A 7/1988 Clearman et al.
4,771,795 A 9/1988 White et al.
4,776,353 A 10/1988 Lilja et al.
4,793,365 A 12/1988 Sensabaugh, Jr. et al.
4,800,903 A 1/1989 Ray et al.
4,819,665 A 4/1989 Roberts et al.
4,821,749 A 4/1989 Toft et al.
4,830,028 A 5/1989 Lawson et al.
4,836,224 A 6/1989 Lawson et al.
4,836,225 A 6/1989 Sudoh
4,848,374 A 7/1989 Chard et al.
4,848,376 A 7/1989 Lilja et al.
4,874,000 A 10/1989 Tamol et al.
4,880,018 A 11/1989 Graves, Jr. et al.
4,887,619 A 12/1989 Burcham, Jr. et al.
4,907,606 A 3/1990 Lilja et al.
4,913,168 A 4/1990 Potter et al.
4,917,119 A 4/1990 Potter et al.
4,917,128 A 4/1990 Clearman et al.
4,922,901 A * 5/1990 Brooks ..... A24F 47/006 128/202.27
4,924,888 A 5/1990 Perfetti et al.
4,928,714 A 5/1990 Shannon
4,938,236 A 7/1990 Banerjee et al.
4,941,483 A 7/1990 Ridings et al.
4,941,484 A 7/1990 Clapp et al.
4,945,931 A 8/1990 Gori
4,947,874 A 8/1990 Brooks et al.
4,947,875 A 8/1990 Brooks et al.
4,972,854 A 11/1990 Kiernan et al.
4,972,855 A 11/1990 Kuriyama et al.
4,986,286 A 1/1991 Roberts et al.
4,987,906 A 1/1991 Young et al.
5,005,593 A 4/1991 Fagg
5,019,122 A 5/1991 Clearman et al.
5,022,416 A 6/1991 Watson
5,042,510 A 8/1991 Curtiss et al.
5,056,537 A 10/1991 Brown et al.
5,060,669 A 10/1991 White et al.
5,060,671 A 10/1991 Counts et al.
5,065,775 A 11/1991 Fagg
5,072,744 A 12/1991 Luke et al.
5,074,319 A 12/1991 White et al.
5,076,296 A 12/1991 Nystrom et al.
5,093,894 A 3/1992 Deevi et al.
5,095,921 A 3/1992 Losee et al.
5,097,850 A 3/1992 Braunshteyn et al.
5,099,862 A 3/1992 White et al.
5,099,864 A 3/1992 Young et al.
5,103,842 A 4/1992 Strang et al.
5,121,757 A 6/1992 White et al.
5,129,409 A 7/1992 White et al.
5,131,415 A 7/1992 Munoz et al.
5,144,962 A 8/1992 Counts et al.
5,143,097 A 9/1992 Sohn et al.
5,146,934 A 9/1992 Deevi et al.
5,159,940 A 11/1992 Hayward et al.
5,159,942 A 11/1992 Brinkley et al.
5,179,966 A 1/1993 Losee et al.
5,211,684 A 5/1993 Shannon et al.
5,220,930 A 6/1993 Gentry
5,224,498 A 7/1993 Deevi et al.
5,228,460 A 7/1993 Sprinkel, Jr. et al.
5,230,354 A 7/1993 Smith et al.
5,235,992 A 8/1993 Sensabaugh
5,243,999 A 9/1993 Smith
5,246,018 A 9/1993 Deevi et al.
5,249,586 A 10/1993 Morgan et al.
5,261,424 A 11/1993 Sprinkel, Jr.
5,269,327 A 12/1993 Counts et al.
5,285,798 A 2/1994 Banerjee et al.
5,293,883 A 3/1994 Edwards
5,301,694 A 4/1994 Raymond
5,303,720 A 4/1994 Banerjee et al.
5,318,050 A 6/1994 Gonzalez-Parra et al.
5,322,075 A 6/1994 Deevi et al.
5,322,076 A 6/1994 Brinkley et al.
5,339,838 A 8/1994 Young et al.
5,345,951 A 9/1994 Serrano et al.
5,353,813 A 10/1994 Deevi et al.
5,357,984 A 10/1994 Farrier et al.
5,360,023 A 11/1994 Blakley et al.
5,369,723 A 11/1994 Counts et al.
5,372,148 A 12/1994 McCafferty et al.
5,377,698 A 1/1995 Litzinger et al.
5,388,574 A 2/1995 Ingebrethsen et al.
5,388,594 A 2/1995 Counts et al.
5,408,574 A 4/1995 Deevi et al.
5,435,325 A 7/1995 Clapp et al.
5,445,169 A 8/1995 Brinkley et al.
5,468,266 A 11/1995 Bensalem et al.
5,468,936 A 11/1995 Deevi et al.
5,479,948 A 1/1996 Counts et al.
5,498,850 A 3/1996 Das
5,498,855 A 3/1996 Deevi et al.
5,499,636 A 3/1996 Baggett, Jr. et al.
5,501,237 A 3/1996 Young et al.
5,505,214 A 4/1996 Collins et al.
5,530,225 A 6/1996 Hajaligol
5,551,450 A 9/1996 Hemsley
5,551,451 A 9/1996 Riggs et al.
5,564,442 A 10/1996 MacDonald et al.
5,573,692 A 11/1996 Das et al.
5,591,368 A 1/1997 Fleischhauer et al.
5,593,792 A 1/1997 Farrier et al.
5,595,577 A 1/1997 Bensalem et al.
5,596,706 A 1/1997 Sikk et al.
5,611,360 A 3/1997 Tang
5,613,504 A 3/1997 Collins et al.
5,613,505 A 3/1997 Campbell et al.
5,649,552 A 7/1997 Cho et al.
5,649,554 A 7/1997 Sprinkel et al.
5,659,656 A 8/1997 Das
5,665,262 A 9/1997 Hajaligol et al.
5,666,976 A 9/1997 Adams et al.
5,666,977 A 9/1997 Higgins et al.
5,666,978 A 9/1997 Counts et al.
5,692,525 A 12/1997 Counts et al.
5,692,526 A 12/1997 Adams et al.
5,708,258 A 1/1998 Counts et al.
5,711,320 A 1/1998 Martin
5,726,421 A 3/1998 Fleischhauer et al.
5,727,571 A 3/1998 Meiring et al.
5,730,158 A 3/1998 Collins et al.
5,750,964 A 5/1998 Counts et al.
5,799,663 A 9/1998 Gross et al.
5,816,263 A 10/1998 Counts et al.
5,819,756 A 10/1998 Mielordt
5,829,453 A 11/1998 White et al.
5,865,185 A 2/1999 Collins et al.
5,865,186 A 2/1999 Volsey, II
5,878,752 A 3/1999 Adams et al.
5,880,439 A 3/1999 Deevi et al.
5,915,387 A 6/1999 Baggett, Jr. et al.

(56) References Cited

U.S. PATENT DOCUMENTS 5,934,289 A 8/1999 Watkins et al.
5,954,979 A 9/1999 Counts et al.
5,967,148 A 10/1999 Harris et al.
6,026,820 A 2/2000 Baggett, Jr. et al.
6,164,287 A 2/2000 White
6,033,506 A 3/2000 Klett
6,033,623 A 3/2000 Deevi et al.
6,037,032 A 3/2000 Klett et al.
6,040,560 A 3/2000 Fleischhauer et al.
6,043,468 A * 3/2000 Toya ..... C30B 15/14 219/544
6,053,176 A 4/2000 Adams et al.
6,089,857 A 7/2000 Matsuura et al.
6,095,153 A 8/2000 Kessler et al.
6,116,247 A 9/2000 Banyasz et al.
6,119,700 A 9/2000 Fleischhauer et al.
6,125,853 A 10/2000 Susa et al.
6,125,855 A 10/2000 Nevett et al.
6,125,866 A 10/2000 Nichols et al.
6,155,268 A 12/2000 Takeuchi
6,182,670 B1 2/2001 White
6,196,218 B1 3/2001 Voges
6,216,706 B1 4/2001 Kumar et al.
6,289,898 B1 9/2001 Fournier et al.
6,349,729 B1 2/2002 Pham
6,357,671 B1 3/2002 Cewers
6,418,938 B1 7/2002 Fleischhauer et al.
6,446,426 B1 8/2002 Sweeney et al.
6,532,965 B1 3/2003 Ahhulimen et al.
6,598,607 B2 7/2003 Adiga et al.
6,601,776 B1 8/2003 Oljaca et al.
6,615,840 B1 9/2003 Fournier et al.
6,688,313 B2 2/2004 Wrenn et al.
6,701,936 B2 3/2004 Shafer et al.
6,715,494 B1 4/2004 McCoy
6,729,269 B2 5/2004 Ott et al.
6,730,832 B1 5/2004 Dominguez et al.
6,722,756 B2 8/2004 Shayan
6,772,756 B2 8/2004 Shayan
6,803,545 B2 10/2004 Blake et al.
6,803,550 B2 10/2004 Sharpe et al.
6,810,883 B2 11/2004 Felter et al.
6,854,461 B2 2/2005 Nichols
6,854,470 B1 2/2005 Pu
6,994,096 B2 2/2006 Rostami et al.
7,011,096 B2 3/2006 Li et al.
7,017,585 B2 3/2006 Li et al.
7,025,066 B2 4/2006 Lawson et al.
7,117,867 B2 10/2006 Cox et al.
7,163,015 B2 1/2007 Moffitt
7,173,322 B2 2/2007 Cox et al.
7,185,659 B2 3/2007 Sharpe et al.
7,234,470 B2 6/2007 Yang
7,290,549 B2 11/2007 Banerjee et al.
7,293,565 B2 11/2007 Griffin et al.
7,392,809 B2 7/2008 Larson et al.
7,513,253 B2 4/2009 Kobayashi et al.
7,647,932 B2 1/2010 Cantrell et al.
7,690,385 B2 4/2010 Moffitt
7,692,123 B2 4/2010 Baba et al.
7,726,320 B2 6/2010 Robinson et al.
7,810,505 B2 10/2010 Yang
7,832,410 B2 11/2010 Hon
7,878,209 B2 2/2011 Newbery et al.
7,896,006 B2 3/2011 Hamano et al.
8,066,010 B2 11/2011 Newbery et al.
8,079,371 B2 12/2011 Robinson et al.
8,372,510 B2 2/2013 Miller et al.
2002/0146242 A1 10/2002 Vieira
2003/0098299 A1* 5/2003 Hiramatsu ..... C04B 38/0054 219/444.1
2003/0131859 A1 7/2003 Li et al.
2003/0226837 A1 12/2003 Blake et al.
2004/0020500 A1 2/2004 Wrenn et al.
2004/0129280 A1 7/2004 Woodson et al.
2004/0149296 A1 8/2004 Rostami et al.
2004/0200488 A1 10/2004 Felter et al.
2004/0224435 A1 11/2004 Shibata et al.
2004/0226568 A1 11/2004 Takeuchi et al.
2004/0255965 A1 12/2004 Perfetti et al.
2005/0016549 A1 1/2005 Banerjee et al.
2005/0016550 A1 1/2005 Katase
2005/0066986 A1 3/2005 Nestor et al.
2005/0151126 A1 7/2005 Yamakawa et al.
2005/0172976 A1 8/2005 Newman et al.
2005/0274390 A1 12/2005 Banerjee et al.
2006/0016453 A1 1/2006 Kim
2006/0032501 A1 2/2006 Hale et al.
2006/0070633 A1 4/2006 Rostami et al.
2006/0162733 A1 7/2006 McGrath et al.
2006/0185687 A1 8/2006 Hearn et al.
2006/0196518 A1 9/2006 Hon
2007/0074734 A1 4/2007 Braunshteyn et al.
2007/0102013 A1 5/2007 Adams et al.
2007/0215167 A1 9/2007 Crooks et al.
2007/0283972 A1 12/2007 Monsees et al.
2008/0149118 A1 6/2008 Oglesby et al.
2008/0245377 A1 10/2008 Marshall et al.
2008/0257367 A1 10/2008 Paterno et al.
2008/0276947 A1 11/2008 Martzel
2008/0302374 A1 12/2008 Wengert et al.
2009/0011673 A1 1/2009 Ko et al.
2009/0065010 A1 3/2009 Shands
2009/0095311 A1 4/2009 Hon
2009/0095312 A1 4/2009 Herbrich et al.
2009/0126745 A1 5/2009 Hon
2009/0188490 A1 7/2009 Hon
2009/0230117 A1 9/2009 Fernando et al.
2009/0260641 A1 10/2009 Monsees et al.
2009/0260642 A1 10/2009 Monsees et al.
2009/0272379 A1 11/2009 Thorens et al.
2009/0283103 A1 11/2009 Nielsen et al.
2009/0293892 A1 12/2009 Williams et al.
2009/0320863 A1 12/2009 Fernando et al.
2009/0324206 A1 12/2009 Young et al.
2010/0006113 A1 1/2010 Urtsev et al.
2010/0024834 A1 2/2010 Oglesby et al.
2010/0043809 A1 2/2010 Magnon
2010/0059070 A1 3/2010 Potter et al.
2010/0059073 A1 3/2010 Hoffmann et al.
2010/0065075 A1 3/2010 Banerjee et al.
2010/0083959 A1 4/2010 Siller
2010/0163063 A1 7/2010 Fernando et al.
2010/0200006 A1 8/2010 Robinson et al.
2010/0229881 A1 9/2010 Hearn
2010/0242974 A1 9/2010 Pan
2010/0242976 A1 9/2010 Katayama et al.
2010/0258139 A1 10/2010 Onishi et al.
2010/0300467 A1 12/2010 Kuistilla et al.
2010/0307518 A1 12/2010 Wang
2010/0313901 A1 12/2010 Fernando et al.
2011/0005535 A1 1/2011 Xiu
2011/0011396 A1 1/2011 Fang
2011/0036363 A1 2/2011 Urtsev et al.
2011/0036365 A1 2/2011 Chong et al.
2011/0073121 A1 3/2011 Levin et al.
2011/0088707 A1 4/2011 Hajaligol
2011/0094523 A1 4/2011 Thorens et al.
2011/0120480 A1 5/2011 Brenneise
2011/0126847 A1 6/2011 Zuber et al.
2011/0126848 A1 6/2011 Zuber et al.
2011/0155153 A1 6/2011 Thorens et al.
2011/0155718 A1 6/2011 Greim et al.
2011/0162663 A1 7/2011 Bryman
2011/0168194 A1 7/2011 Hon
2011/0180082 A1 7/2011 Banerjee et al.
2011/0265806 A1 11/2011 Alarcon et al.
2011/0309157 A1 12/2011 Yang et al.
2012/0042885 A1 2/2012 Stone et al.
2012/0060853 A1 3/2012 Robinson et al.
2012/0132643 A1 5/2012 Choi et al.
2012/0231464 A1 9/2012 Yu et al.
2012/0318882 A1 12/2012 Abehasera
2013/0081642 A1 4/2013 Safari

(56) References Cited

U.S. PATENT DOCUMENTS

| | | | | |
|---|---|---|---|---|
| 2013/0192620 | A1 | 8/2013 | Tucker et al. | |
| 2013/0306084 | A1 | 11/2013 | Flick | |
| 2013/0340775 | A1 | 12/2013 | Juster et al. | |
| 2014/0238422 | A1* | 8/2014 | Plunkett | A24F 47/008 131/328 |

FOREIGN PATENT DOCUMENTS

| | | |
|---|---|---|
| CN | 1040914 | 4/1990 |
| CN | 1541577 | 11/2004 |
| CN | 2719043 | 8/2005 |
| CN | 1778673 | 5/2006 |
| CN | 200997909 | 1/2008 |
| CN | 101116542 | 2/2008 |
| CN | 101176805 | 5/2008 |
| CN | 201379072 | 1/2010 |
| DE | 10 2006 004 484 | 8/2007 |
| DE | 20 2009 010 400 | 11/2009 |
| EP | 0 295 122 | 12/1988 |
| EP | 0 845 220 | 6/1998 |
| EP | 1 618 803 | 1/2006 |
| EP | 2 316 286 | 5/2011 |
| EP | 2 468 116 | 6/2012 |
| GB | 1444461 | 7/1976 |
| WO | WO 1986/02528 | 5/1986 |
| WO | WO 1997/48293 | 12/1997 |
| WO | WO 02/37990 | 5/2002 |
| WO | WO 2004/043175 | 5/2004 |
| WO | WO 2007/131449 | 11/2007 |
| WO | WO 2009/105919 | 9/2009 |
| WO | WO 2009/155734 | 12/2009 |
| WO | WO 2010/003480 | 1/2010 |
| WO | WO 2010/045670 | 4/2010 |
| WO | WO 2010/091593 | 8/2010 |
| WO | WO 2010/118644 | 10/2010 |
| WO | WO 2010/140937 | 12/2010 |
| WO | WO 2011/010334 | 1/2011 |
| WO | WO 2010/073122 | 7/2011 |
| WO | WO 2011/081558 | 7/2011 |

* cited by examiner

CARBON CONDUCTIVE SUBSTRATE FOR ELECTRONIC SMOKING ARTICLE

FIELD OF THE DISCLOSURE

The present disclosure relates to aerosol delivery devices such as smoking articles, and more particularly to electrically resistive heaters useful in such devices. The electrically resistive heaters may be configured to heat a material, which may be made or derived from tobacco or otherwise incorporate tobacco, to form an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al., U.S. patent application Ser. No. 13/432,406, filed Mar. 28, 2012, U.S. patent application Ser. No. 13/536,438, filed Jun. 28, 2012, U.S. patent application Ser. No. 13/602,871, filed Sep. 4, 2012, and U.S. patent application Ser. No. 13/647,000, filed Oct. 8, 2012, which are incorporated herein by reference.

Certain tobacco products that have employed electrical energy to produce heat for smoke or aerosol formation, and in particular, certain products that have been referred to as electronic cigarette products, have been commercially available throughout the world. Representative products that resemble many of the attributes of traditional types of cigarettes, cigars or pipes have been marketed as ACCORD® by Philip Morris Incorporated; ALPHA™, JOYE 510™ and M4™ by InnoVapor LLC; CIRRUS™ and FLING™ by White Cloud Cigarettes; COHITA™, COLIBRI™, ELITE CLASSIC™, MAGNUM™, PHANTOM™ and SENSE™ by Epuffer® International Inc.; DUOPRO™, STORM™ and VAPORKING® by Electronic Cigarettes, Inc.; EGAR™ by Egar Australia; eGo-C™ and eGo-T™ by Joyetech; ELUSION™ by Elusion UK Ltd; EONSMOKE® by Eonsmoke LLC; GREEN SMOKE® by Green Smoke Inc. USA; GREENARETTE™ by Greenarette LLC; HALLIGAN™, HENDU™, JET™, MAXXQ™, PINK™ and PITBULL™ by Smoke Stik®; HEATBAR™ by Philip Morris International, Inc.; HYDRO IMPERIALT™ and LXE™ from Crown7; LOGIC™ and THE CUBAN™ by LOGIC Technology; LUCI® by Luciano Smokes Inc.; METRO® by Nicotek, LLC; NJOY® and ONEJOY™ by Sottera, Inc.; NO. 7™ by SS Choice LLC; PREMIUM ELECTRONIC CIGARETTE™ by PremiumEstore LLC; RAPP E-MYSTICKT™ by Ruyan America, Inc.; RED DRAGON™ by Red Dragon Products, LLC; RUYAN® by Ruyan Group (Holdings) Ltd.; SMART SMOKER® by The Smart Smoking Electronic Cigarette Company Ltd.; SMOKE ASSIST® by Coastline Products LLC; SMOKING EVERYWHERE® by Smoking Everywhere, Inc.; V2CIGS™ by VMR Products LLC; VAPOR NINE™ by VaporNine LLC; VAPOR4LIFE® by Vapor 4 Life, Inc.; VEPPO™ by E-CigaretteDirect, LLC and VUSE® by R. J. Reynolds Vapor Company. Yet other electrically powered aerosol delivery devices, and in particular those devices that have been characterized as so-called electronic cigarettes, have been marketed under the tradenames BLU™; COOLER VISIONS™; DIRECT E-CIG™; DRAGONFLY™; EMIST™; EVERSMOKE™; GAMUCCI®; HYBRID FLAME™; KNIGHT STICKS™; ROYAL BLUES™; SMOKETIP® and SOUTH BEACH SMOKET™.

It would be desirable to provide a smoking article that employs heat produced by electrical energy to provide the sensations of cigarette, cigar, or pipe smoking, that does so without combusting tobacco to any significant degree, that does so without the need of a combustion heat source, and that does so without necessarily delivering considerable quantities of incomplete combustion and pyrolysis products. Further, advances with respect to manufacturing electronic smoking articles would be desirable.

SUMMARY OF THE DISCLOSURE

The present disclosure relates to materials and combinations thereof useful in aerosol formation, particularly in an electronic smoking article or like vapor forming device. In various embodiments, the materials useful in aerosol formation can be comprised largely from carbon materials. Such materials in particular can be used in a cartridge of an electronic smoking article and, in some embodiments, the dry components of the cartridge can be formed predominately or completely from carbon. Such structuring can beneficially improve the disposable nature of the cartridge. In particular, slow degrading materials, such as metal and synthetic polymer components, that are typically present in cartridges for electronic smoking articles can be avoided.

In one aspect, the present disclosure provides an electrically resistive heater formed of a porous carbon material, such as a carbon foam. The porous carbon heater can be adapted for use in an electronic smoking article or a component thereof. For example, in certain embodiments, the present disclosure provides an atomizer of an electronic smoking article. Specifically, the atomizer can comprise the electrically resistive heater formed of a porous carbon. Preferably, the porous carbon can comprise about 90% or greater of the dry mass of the electrically resistive heater. In some embodiments, the electrically resistive heater consists essentially of the porous carbon. In other embodiments, the electrically resistive heater consists of the porous carbon. In further embodiments, the electrically resistive heater can expressly exclude electrically conductive materials that are not porous carbon, such as metals and graphite.

The porous carbon used as the electrically resistive heating element can be characterized by specific properties. For example, the dry mass of the porous carbon can be about 90% or greater carbon. The porous carbon can be characterized as comprising a plurality of pores. Preferably, a majority of the pores are closed pores. More specifically, about 80% or greater by volume of the pores can be closed pores. In additional embodiments, the porous carbon heater can have a density of about 0.1 $g/cm^3$ to about 0.5 $g/cm^3$. Further, the porous carbon heater can have an aqueous liquid retention capacity that less than or equal to about 100% of the dry mass of the porous carbon heater.

In further embodiments, the porous carbon heater can be characterized by its resistivity and effective heating upon application of an electrical current. For example, the porous carbon heater can exhibit a resistivity of about $1.0\times10^{-3}$ Ω·m to about $1.0\times10^{-4}$ Ω·m. As such, the porous carbon heater can be adapted to achieve a temperature of about 150° C. to about 550° C. when subjected to an electrical current of about 0.2 amps to about 12 amps for a time of about 1 second to about 3 seconds.

In some embodiments, the porous carbon heater may also function as a reservoir for an aerosol precursor material. Specifically, an aerosol precursor material may be contained by, coated on, absorbed by, or adsorbed on the carbon foam heater.

In other embodiments, an atomizer may include, in addition to the porous carbon heater, an aerosol precursor transport element. Specifically, the aerosol precursor transport element can be arranged so as to be in direct contact with the porous carbon heater. In some embodiments, the aerosol precursor transport element can surround the porous carbon heater. In other embodiments, the aerosol precursor transport element can be a fibrous material. In additional embodiments, the aerosol precursor transport element can comprise a capillary. In further embodiments, the aerosol precursor transport element can be at least partially embedded within the carbon foam heater.

In particular embodiments, the aerosol precursor transport element can be formed of carbon fibers. The carbon fiber aerosol precursor transport element can have a dry mass of about 85% or greater carbon. More specifically, the carbon fiber aerosol precursor transport element can comprise a carbonized fabric. The aerosol precursor transport element further can comprise an aerosol precursor material.

In some embodiments, the porous carbon heater can be elongated having a first end and having a second, opposing end. One end or both ends can be adapted for electrical connection with an electrical power source.

The aerosol precursor transport element can take on a variety of conformations useful for facilitating transfer of the aerosol precursor material to the porous carbon heater. In one embodiment, the aerosol precursor transport element can be substantially arc-shaped so as to only partially surround the porous carbon heater. For example, the arc-shaped aerosol precursor transport element can have an inner arc surface in at least partial contact with the porous carbon heater and an outer arc surface spaced apart from the inner arc surface. The thus shaped component may be described as a partial disc and can have a defined width measured from the inner arc surface to the outer arc surface and a thickness measured from a first face to an opposing, second face. The aerosol precursor transport element can be positioned proximate the first end of the porous carbon heater. As further described herein, the above is only exemplary of the nature of the aerosol precursor transport element in some embodiments and should not be viewed as limiting the shape of the component.

In additional embodiments, an electrical connector can be utilized and can have a first end in electrical connection with the second end of the porous carbon heater and can have a second, opposing end adapted for electrical connection with the electrical power source. In specific embodiments, the electrical connector can be non-metallic. For example, the electrical connector can be formed of graphite. Other electrically conductive materials, however, may also be used. As further discussed herein, additional elements can be included to complete an electrical circuit with the battery, the electrical connector, and the porous carbon heater.

In another aspect, the present disclosure also relates to a cartridge of an electronic smoking article. A cartridge can comprise an outer housing or shell and can be adapted for attachment to a control body. A cartridge may include a variety of components such as (separately or in various combinations) a heater, a liquid storage element, a liquid transport element, electrical connections, an insulator, and a filter material.

In certain embodiments, a cartridge of an electronic smoking article according to the present disclosure can comprise an elongated, electrically resistive heater formed of a porous carbon, such as a carbon foam, the porous carbon heater having a first end and a second, opposing end adapted for electrical connection with an electrical power source. The cartridge also can include an aerosol precursor transport element arranged so as to be in direct contact with the porous carbon heater. The cartridge further can comprise an electrical connector having a first end in electrical connection with the second end of the porous carbon heater and having a second, opposing end adapted for electrical connection with an electrical power source. The cartridge also can comprise a housing having a first end proximate the first end of the porous carbon heater and a second end proximate the second end of the electrical connector. The cartridge further can comprise a fibrous material surrounding at least a portion of the cartridge. The fibrous material can be a filter, and the filter can include a filter extension that extends beyond the first end of the housing. The filter and/or the filter extension can include one or more flavor capsules. The cartridge also can comprise an aerosol precursor material.

In additional embodiments, a cartridge according to the disclosure can be defined by a variety of characteristics that may be embodied singly or in several combinations. For example, a cartridge may be defined by one or more of the following:

- the porous carbon can comprise about 90% or greater by mass of the porous carbon heater;
- the dry mass of the porous carbon can be about 90% or greater carbon;
- the porous carbon heater can have a density of about 0.1 g/cm$^3$ to about 0.5 g/cm$^3$;
- the aerosol precursor transport element can at least partially surrounds the porous carbon heater;
- the aerosol precursor transport element can be formed of carbon fibers;
- the dry mass of the carbon fiber aerosol precursor transport element can be about 85% or greater carbon;
- the carbon fiber aerosol precursor transport element can comprise a carbonized fabric;
- the carbonized fabric can be woven or non-woven;
- the carbon fiber aerosol precursor transport element can comprise a carbonized bale, yarn, or tow;
- the aerosol precursor transport element can be arc-shaped having an inner arc surface in at least partial contact with the porous carbon heater and an outer arc surface spaced apart from the inner arc surface;
- the aerosol precursor transport element can have a variety of cross-sectional shapes, such as circle, triangle, square, star, and the like;
- the aerosol precursor transport element can be positioned proximate the first end of the porous carbon heater;
- the electrical connector can be non-metallic;
- the electrical connector can be formed of graphite;

In further embodiments, the second end of the housing can be adapted for forming a structural connection with a first end of a power unit including the electrical power source. In particular, the structural connection can be a threaded connection. Alternatively, the structural connection can be a press fit connection or snap-fit connection.

In certain embodiments, the first end of the housing can comprise a wall comprising an alignment recess adapted to engage the first end of the porous carbon heater. The engagement can form an electrical connection between the porous carbon heater and the housing. The housing wall at the first end can include one or more through holes adapted for passage of an aerosol therethrough.

In other embodiments, the second end of the housing can include a flange. In particular, the flange can have a greater diameter than the diameter of the remaining portion of the housing. The housing can be formed of a carbon material. For example, the carbon material can be graphite.

In some embodiments, a cartridge further can comprise a fibrous material surrounding at least a portion of the cartridge. The fibrous material can comprise a filter material.

In certain embodiments, the electrical connector, the porous carbon heater, and the housing can form an electrical circuit, which may also include a power source and one or more control elements (e.g., a microcontroller).

A cartridge according to the present disclosure can be defined in yet further manners. For example, the cartridge can be free of metal. A majority of the total dry mass of all components of the cartridge can be carbon. More specifically, the total dry mass of all components of the cartridge can be about 75% or greater carbon. In an exemplary embodiment, a cartridge of an electronic smoking article according to the present disclosure can comprise an electrically resistive heater, an aerosol precursor transport element, and a housing, wherein a majority of the total dry mass all components of the cartridge is carbon. More particularly, such cartridge can be free of metal.

In another aspect, the present disclosure can relate to an electronic smoking article. Such smoking article can comprise a housing or shell. Specifically, the smoking article can comprise a cartridge having an outer housing and a separate control body having an outer housing, the cartridge and the control body being detachably connected. In certain embodiments, an electronic smoking article according to the present disclosure can comprise an electrical power source and an elongated, electrically resistive heater formed of a porous carbon, such as a carbon foam, the porous carbon heater having a first end and a second, opposing end adapted for electrical connection with the electrical power source. The smoking article further can comprise an aerosol precursor transport element arranged so as to be in direct contact with the porous carbon heater. In further embodiments, the smoking article can comprise an electrical connector having a first end in electrical connection with the second end of the porous carbon heater and having a second, opposing end adapted for electrical connection with the electrical power source. The porous carbon heater particularly can be arranged within a cartridge housing and the electrical power source particularly can be arranged within a separate control body housing. The cartridge housing can have a first end proximate the first end of the porous carbon heater and a second end proximate the second end of the electrical connector. Further, the second end of the housing can be adapted for forming a structural connection with a first end of the control body housing. In some embodiments, the first end of the cartridge housing can comprise a wall comprising an alignment recess adapted to engage the first end of the porous carbon heater, and the engagement can form an electrical connection between the porous carbon heater and the housing. In particular, the electrical connector, the porous carbon heater, and the housing can form an electrical circuit.

In further embodiments, an electronic smoking article according to the present disclosure can comprise an aerosol precursor material. Moreover, such electronic smoking article can be defined in relation to the specific description of components of the electronic smoking as otherwise provided herein. Thus, the description of an atomizer and its components, the description of a cartridge and its components, and the description of a control body and its components all can apply to the electronic smoking article in a variety of combinations. In one embodiment, an electronic smoking article can comprise an electrical power source and an electrically resistive heater formed of a porous carbon, such as a carbon foam, wherein the porous carbon heater is in a metal-free (e.g., wire-free) electrical connection with the electrical power source.

In still another aspect, the present disclosure also can relate to a method of heating an aerosol precursor material and forming an aerosol, such as in an electronic smoking article. In one embodiment, such method can comprise the step of connecting a cartridge of the electronic smoking article to a control body of the electronic smoking article. In particular, the control body can comprise an electrical power source, a pressure sensor, an electronic controller, and a control body housing. The cartridge can comprise: an elongated, electrically resistive heater formed of a porous carbon, such as a carbon foam, the porous carbon heater having a first end and a second, opposing end; an aerosol precursor transport element arranged so as to be in direct contact with the porous carbon heater; an electrical connector having a first end in electrical connection with the second end of the porous carbon heater and having a second, opposing end adapted for electrical connection with the electrical power source; and a cartridge housing having a first end including an end wall with an alignment recess adapted to engage the first end of the porous carbon heater and a second end proximate the second end of the electrical connector, the second end of the housing being adapted for forming a structural connection with a first end of the control body housing, and wherein the electrical connector, the porous carbon heater, and the cartridge housing form an electrical circuit. The method further can comprise the following steps: causing a pressure change within the electronic smoking article such that the pressure sensor signals the electronic controller to cause a flow of electrical current from the electrical power source to the cartridge; causing the electrical current to flow through the electrical circuit of the cartridge so as to cause heating of the porous carbon heater; and causing the aerosol precursor material in the aerosol precursor transport element to vaporize, mix with air, and form an aerosol.

BRIEF DESCRIPTION OF THE FIGURES

Figure 1:
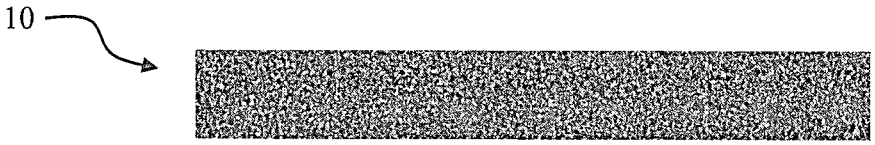
Figure 2:
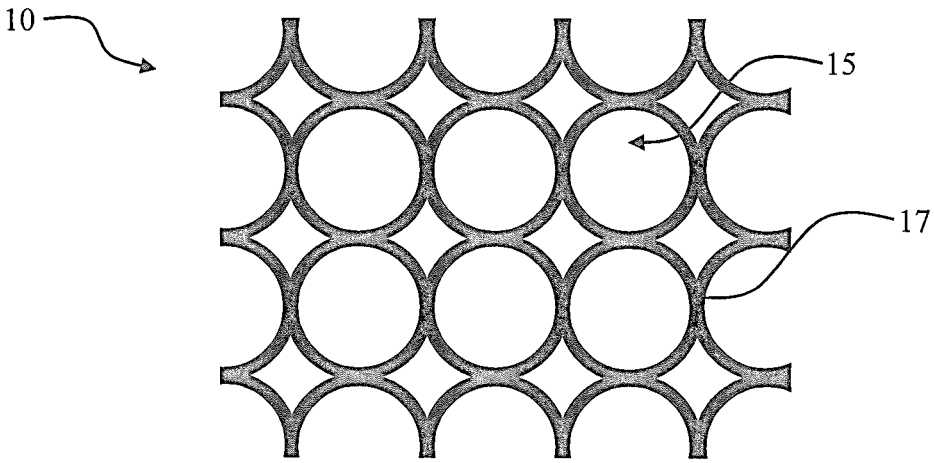
Figure 3:
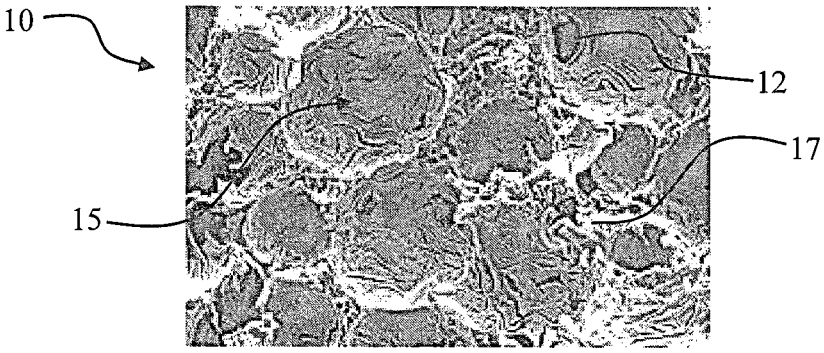
Figure 4:
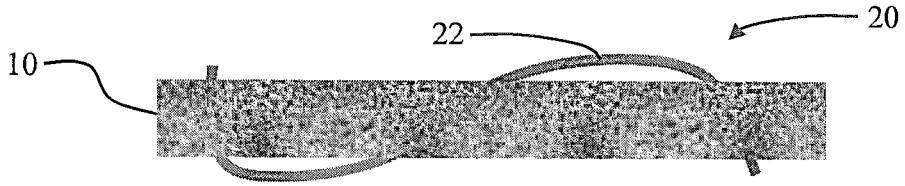
Figure 5:
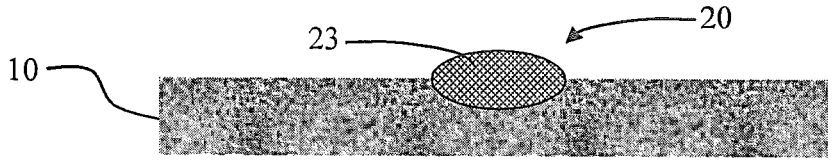
Figure 6:
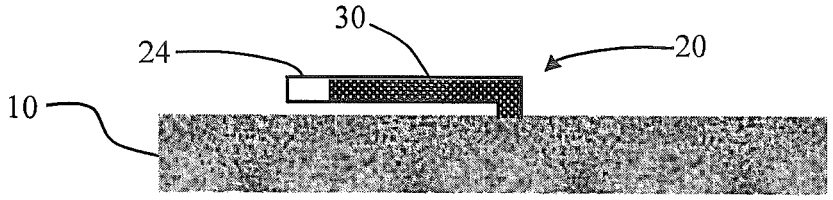
Figure 7:
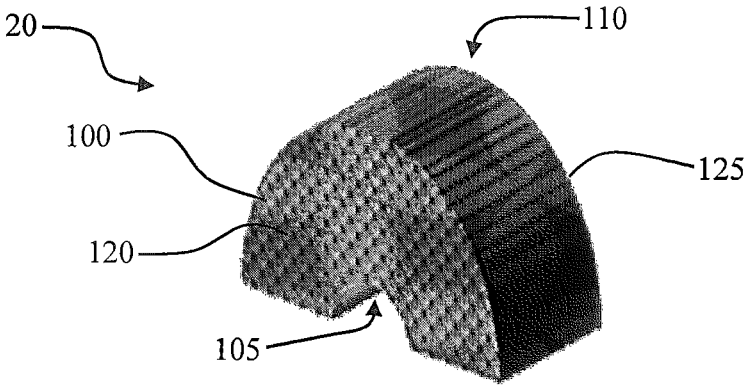
Figure 8:
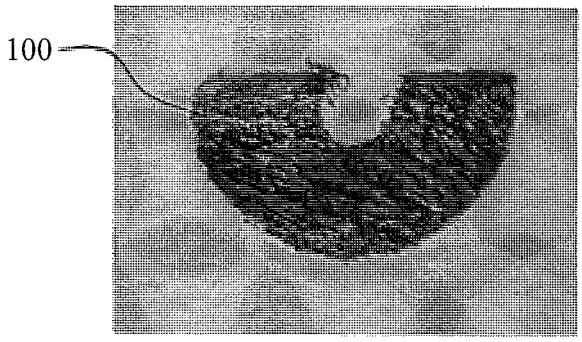
Figure 9:
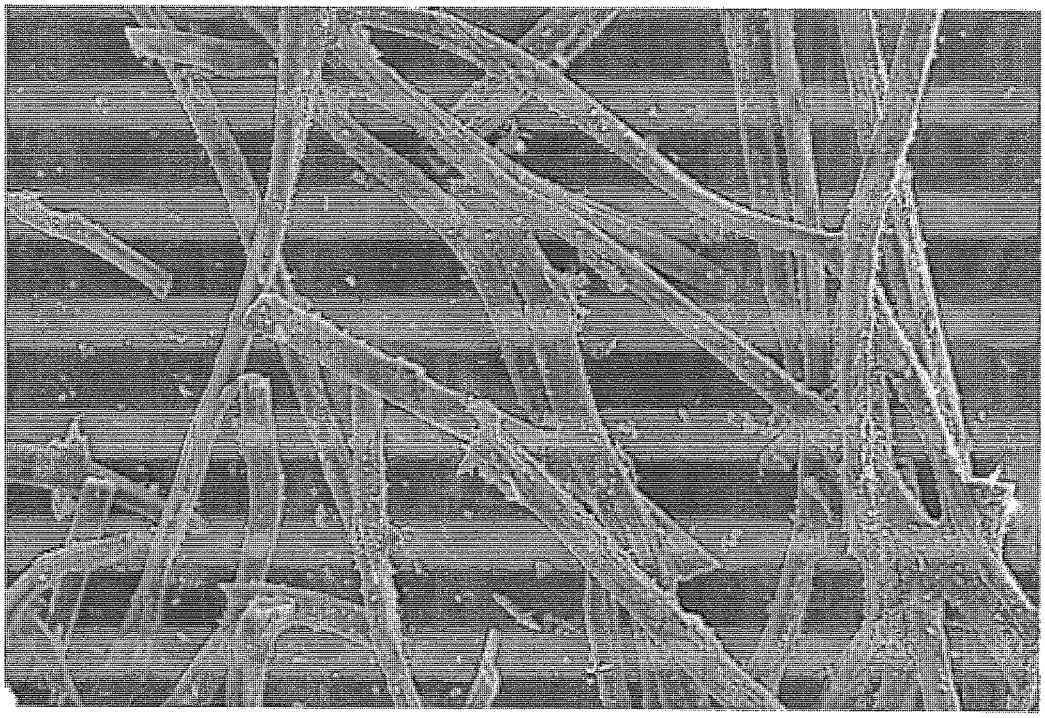
Figure 10:
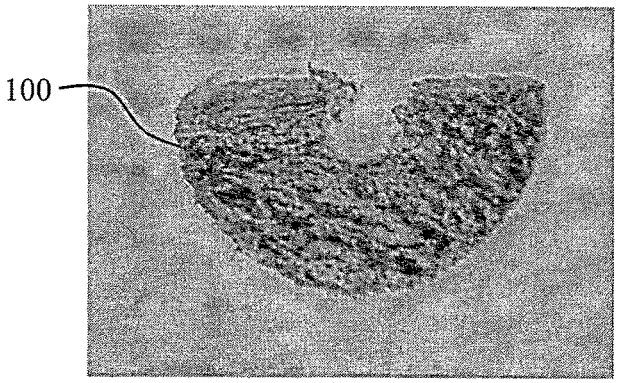
Figure 11:
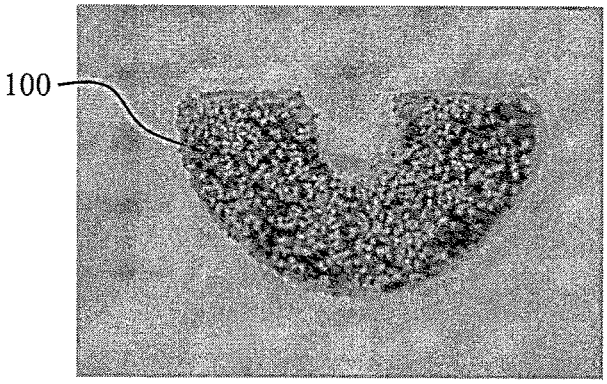
Figure 12:
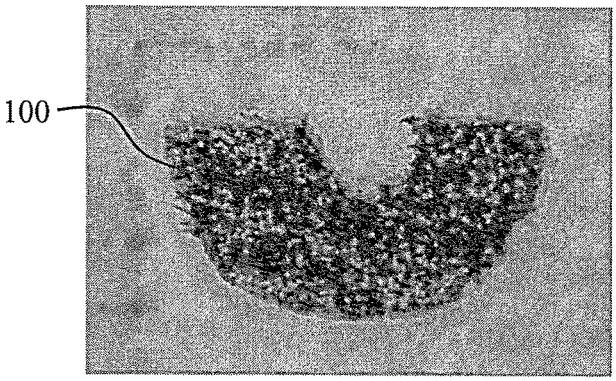
Figure 13:
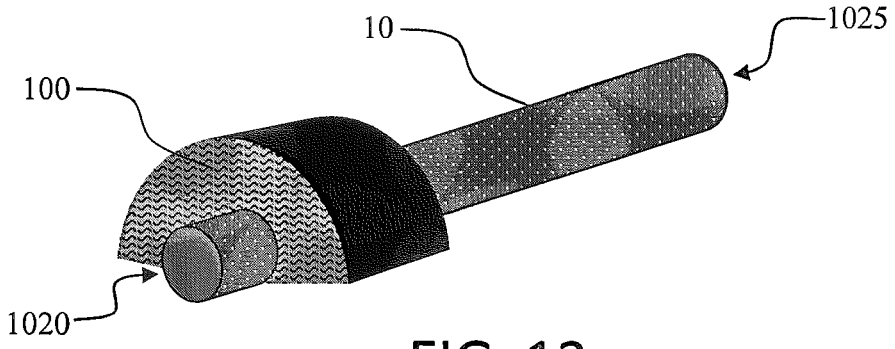
Figure 14:
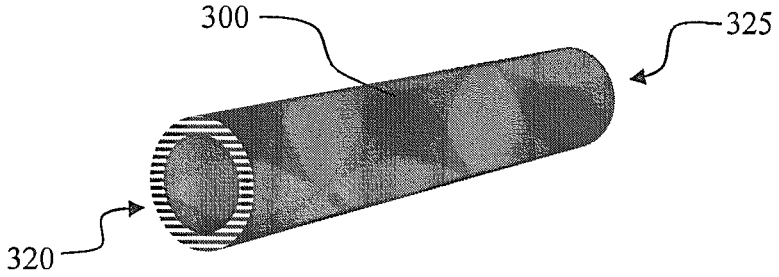
Figure 15:
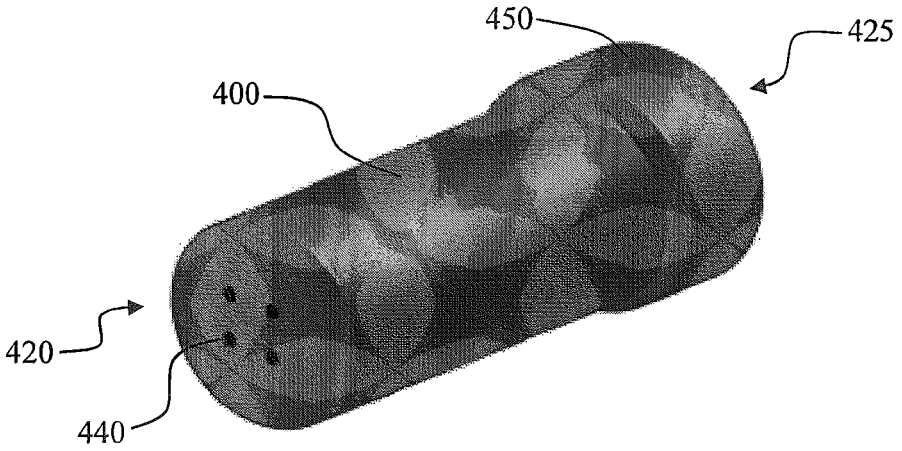
Figure 16A:
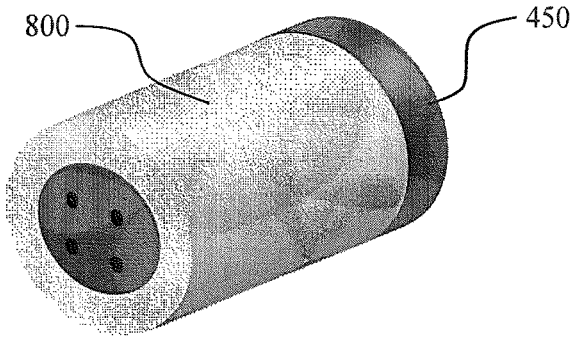
Figure 16B:
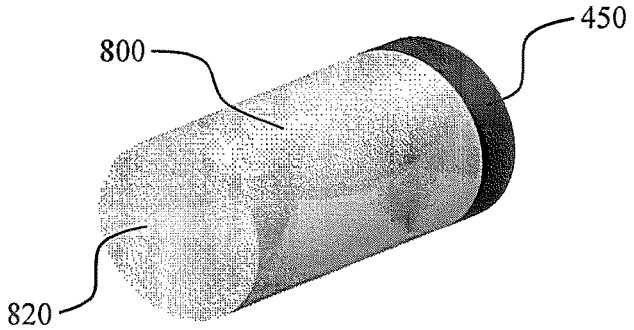
Figure 16C:
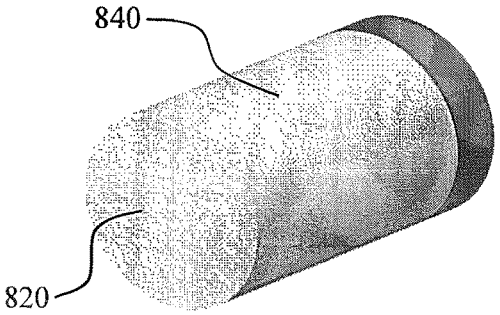
Figure 17A:
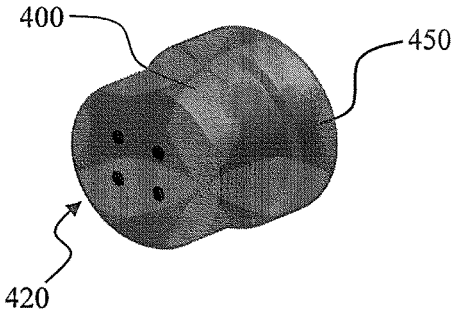
Figure 17B:
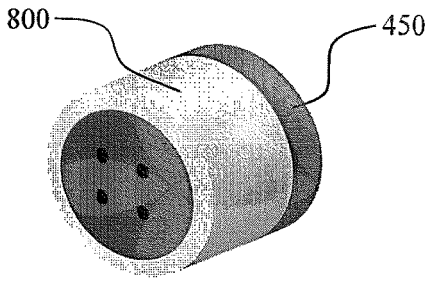
Figure 17C:
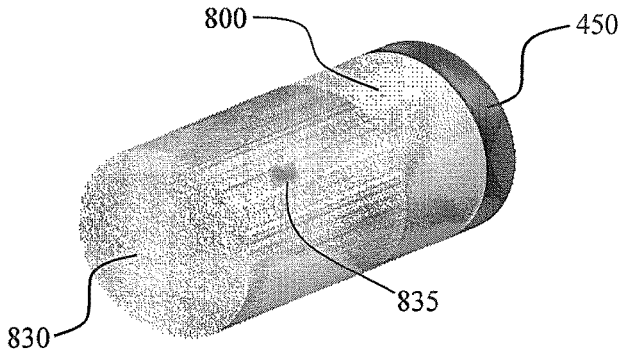
Figure 17D:
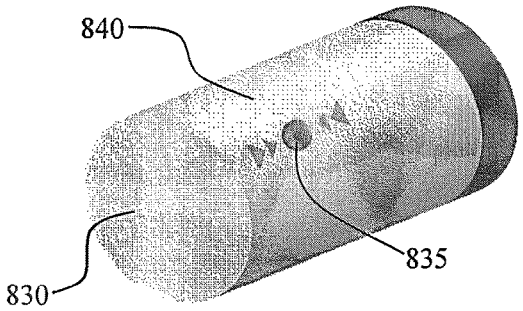
Figure 18A:
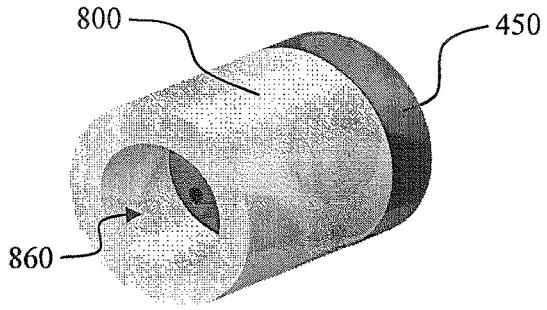
Figure 18B:
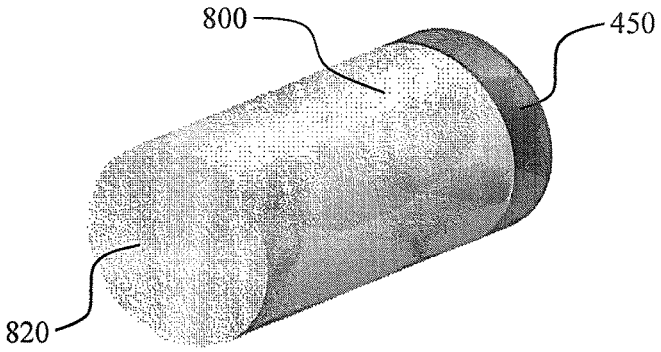
Figure 18C:
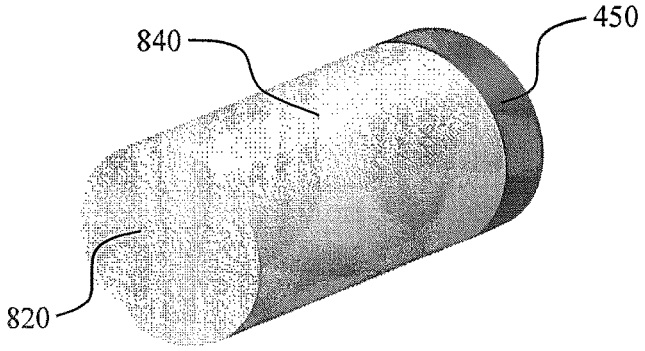
Figure 19:
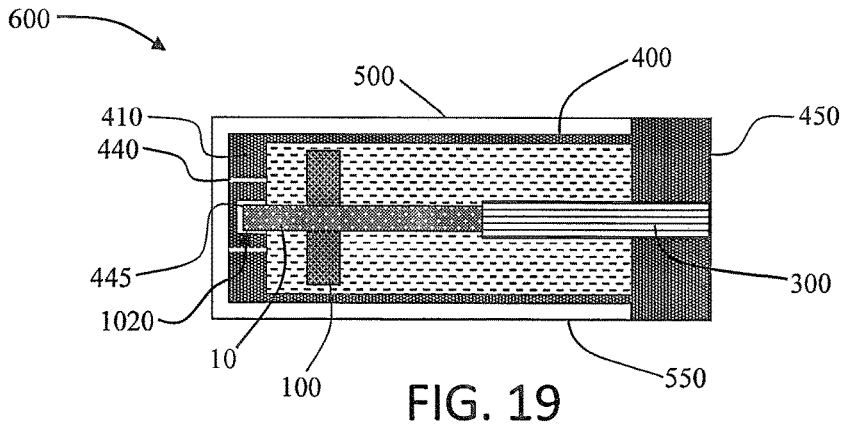
Figure 20:
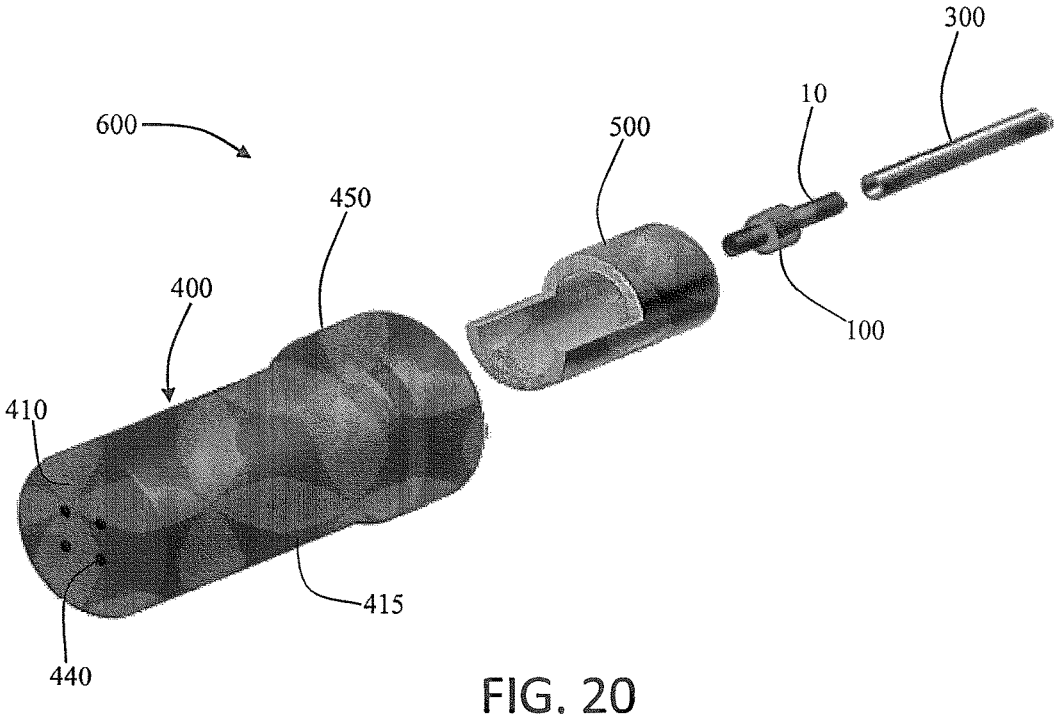
Figure 21:
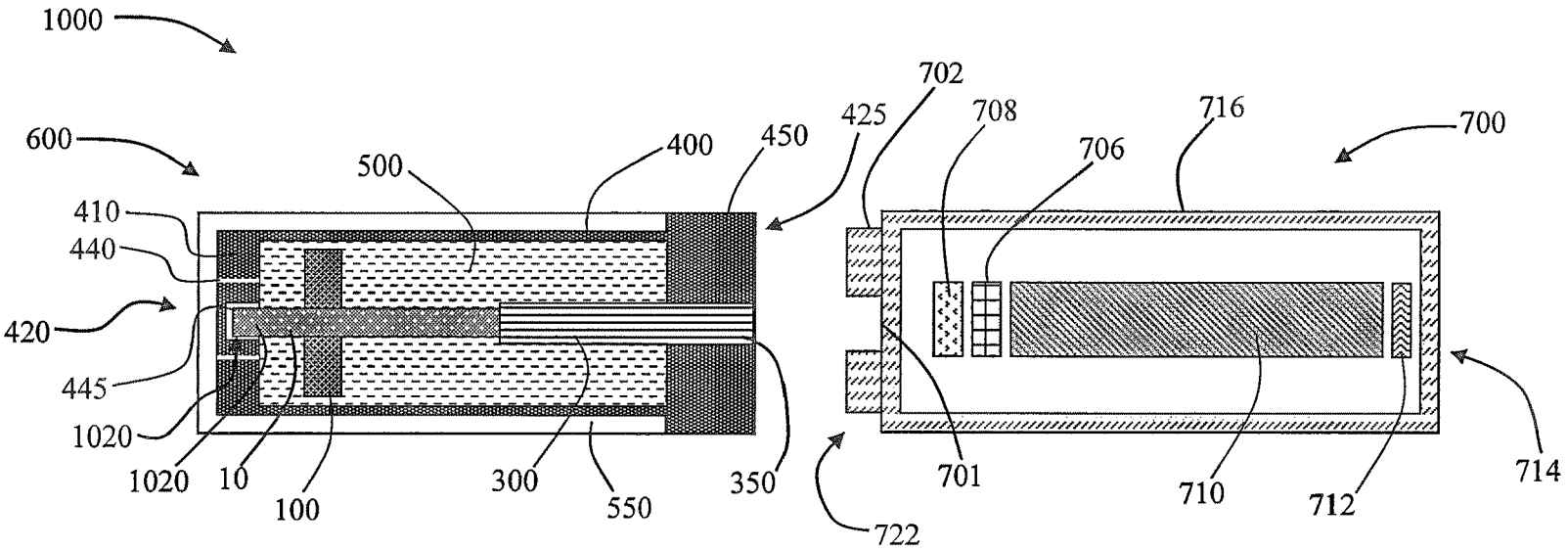
Figure 22:
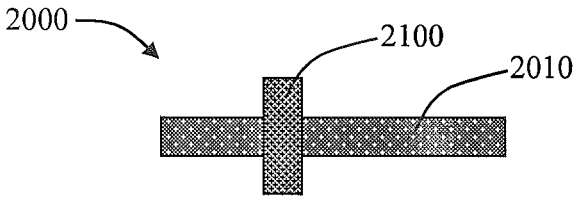
Figure 23:
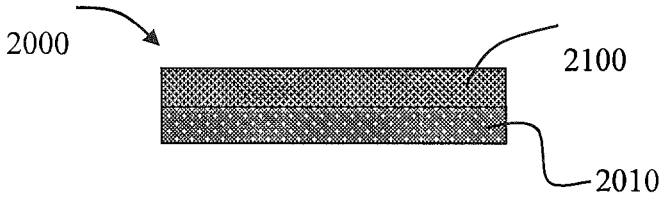
Figure 24:
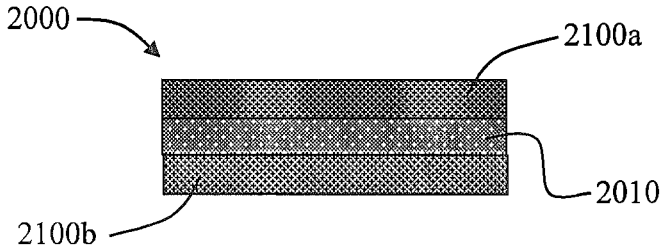
Figure 25:
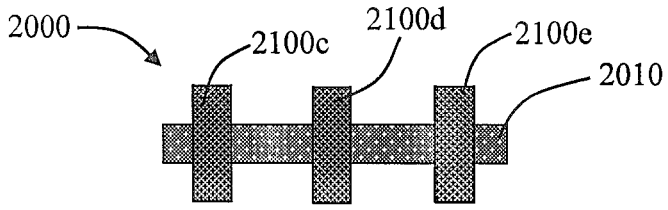

Having thus described the disclosure in the foregoing general terms, reference will now be made to the accompanying drawings, which are not necessarily drawn to scale, and wherein:

FIG. 1 is an illustration of a porous carbon material useful according to embodiment of the present disclosure;

FIG. 2 is an illustration of a detailed portion of a porous carbon showing the individual, closed cells;

FIG. 3 is a scanning electron micrograph (SEM) of a porous carbon showing the cell structure and interconnectedness;

FIG. 4 is an illustration of a combination of a porous carbon heater and a fibrous aerosol precursor transport element according to an embodiment of the present disclosure;

FIG. 5 is an illustration of a combination of a porous carbon heater and a fibrous aerosol precursor transport element according to a further embodiment of the present disclosure;

FIG. 6 is an illustration of a combination of a porous carbon heater and a capillary aerosol precursor transport element according to an embodiment of the present disclosure;

FIG. 7 is an illustration of an aerosol precursor transport element in the form of a carbonized fabric useful according to an embodiment of the present disclosure;

FIG. 8 is an image of a carbonized fabric aerosol precursor transport element according to an embodiment of the present disclosure;

FIG. 9 is a scanning electron micrograph (SEM) of a carbonized fabric showing the individual fibers thereof;

FIG. 10 is an image of a carbonized fabric aerosol precursor transport element according to an embodiment of the present disclosure prior to application of the aerosol precursor transport solution;

FIG. 11 is an image of the carbonized fabric aerosol precursor transport element of FIG. 10 immediately after application of the aerosol precursor transport solution;

FIG. 12 is an image of the carbonized fabric aerosol precursor transport element of FIG. 11 after the aerosol precursor transport element has been heated through contact with a porous carbon heater to drive off a portion of the aerosol precursor transport solution;

FIG. 13 is an illustration of an atomizer according to an embodiment of the present disclosure showing a porous carbon heater combined with a carbonized fabric aerosol precursor transport element;

FIG. 14 is an illustration of an electrical connector useful according to an embodiment of the present disclosure;

FIG. 15 is an illustration of a housing for a cartridge according to an embodiment of the present disclosure;

FIG. 16*a* is an illustration of a housing with a hollow tube filter wrapped therearound according to an embodiment of the present disclosure;

FIG. 16*b* is an illustration of the housing shown in FIG. 16*a* further including a filter extension combined therewith according to an embodiment of the present disclosure;

FIG. 16*c* is an illustration of the housing shown in FIG. 16*b* further including an external layer of tipping paper according to an embodiment of the present disclosure;

FIG. 17*a* is an illustration of a shortened housing according to an embodiment of the present disclosure;

FIG. 17*b* is an illustration of the housing shown in FIG. 17*a* further including a hollow tube filter wrapped therearound according to an embodiment of the present disclosure;

FIG. 17*c* is an illustration of the housing shown in FIG. 17*b* further including a filter extension combined therewith according to an embodiment of the present disclosure, the filter extension being partially transparent and including a flavor capsule therein;

FIG. 17*d* is an illustration of the housing shown in FIG. 17*c* further including an external layer of tipping paper according to an embodiment of the present disclosure, the tipping paper being partially transparent;

FIG. 18*a* is an illustration of a housing with a hollow tube filter wrapped therearound according to an embodiment of the present disclosure, the tube filter having a length so as to extend beyond the end of the housing component;

FIG. 18*b* is an illustration of the housing shown in FIG. 18*a* further including a filter extension combined therewith according to an embodiment of the present disclosure;

FIG. 18*c* is an illustration of the housing shown in FIG. 18*b* further including an external layer of tipping paper according to an embodiment of the present disclosure;

FIG. 19 is an illustration of a cross-section of a cartridge according to an embodiment of the present disclosure showing the assembled cartridge including a porous carbon heater element, a carbonized fabric aerosol precursor transport element, a graphite electrical connector, a graphite housing, and a fibrous wrapping on the housing;

FIG. 20 is an exploded view of the components of a cartridge according to an embodiment of the present disclosure, including a porous carbon heater element, a carbonized fabric aerosol precursor transport element, a graphite electrical connector, an insulating sheath, and a graphite housing;

FIG. 21 is an illustration of a cross-section of an electronic smoking article according to an embodiment of the present disclosure including a cartridge and a control body;

FIG. 22 is an illustration of an atomizer according to an embodiment of the present disclosure comprising a porous carbon heater with a carbonized fabric aerosol precursor transport element surrounding the heater;

FIG. 23 is an illustration of an atomizer according to an embodiment of the present disclosure comprising a porous carbon heater with a carbonized fabric aerosol precursor transport element in parallel with the heater;

FIG. 24 is an illustration of an atomizer according to an embodiment of the present disclosure comprising a porous carbon heater with two carbonized fabric aerosol precursor transport elements in parallel with the heater; and FIG. 25 is an illustration of an atomizer according to an embodiment of the present disclosure comprising a porous carbon heater with three carbonized fabric aerosol precursor transport elements surrounding the heater.

DETAILED DESCRIPTION

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides descriptions of aerosol delivery devices that use electrical energy to heat a material (preferably without combusting the material to any significant degree) to form an inhalable substance; such articles most preferably being sufficiently compact to be considered "hand-held" devices. In certain highly preferred embodiments, the aerosol delivery devices can be characterized as smoking articles. As used herein, the term "smoking article" is intended to mean an article or device that provides some or all of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article or device. As used herein, the term "smoking article" does not necessarily mean that, in operation, the article or device produces smoke in the sense of the aerosol resulting from by-products of combustion or pyrolysis of tobacco, but rather, that the article or device yields vapors (including, e.g., vapors within aerosols that can be considered to be visible aerosols that might be considered to be described as smoke-like) resulting from volatilization or vaporization of certain components of the article or device. In highly preferred embodiments, articles or devices characterized as smoking articles incorporate tobacco and/or components derived from tobacco.

Articles or devices of the present disclosure also can be characterized as being vapor-producing articles, aerosol delivery articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

In use, smoking articles of the present disclosure may be subjected to many of the physical actions employed by an individual in using a traditional type of smoking article (e.g., a cigarette, cigar or pipe that is employed by lighting and inhaling tobacco). For example, the user of a smoking article of the present disclosure can hold that article much like a traditional type of smoking article, draw on one end of that article for inhalation of aerosol produced by that article, take puffs at selected intervals of time, etc.

Smoking articles of the present disclosure generally include a number of components provided within an outer shell or body. The overall design of the outer shell or body can vary, and the format or configuration of the outer body defining the overall size and shape of the smoking article can vary. Typically, an elongated body resembling the shape of a cigarette or cigar can be a formed from a single, unitary shell; or the elongated body can be formed of two or more separable pieces. For example, a smoking article can comprise an elongated shell or body that can be substantially tubular in shape and, as such, resemble the shape of a conventional cigarette or cigar. In one embodiment, all of the components of the smoking article can be contained within one outer body or shell. Alternatively, a smoking article can comprise two or more shells that are joined and are separable. For example, a smoking article can possess at one end a control body comprising a shell containing one or more reusable components (e.g., a rechargeable battery and various electronics for controlling the operation of that article), and at the other end and removably attached thereto a shell containing a disposable portion (e.g., a disposable flavor-containing cartridge). More specific formats, configurations and arrangements of components within the single shell type of unit or within a multi-piece separable shell type of unit will be evident in light of the further disclosure provided herein. Additionally, various smoking article designs and component arrangements can be appreciated upon consideration of the commercially available electronic smoking articles, such as those representative products listed in the background art section of the present disclosure.

Smoking articles of the present disclosure most preferably comprise some combination of a power source (i.e., an electrical power source), at least one control component (e.g., means for actuating, controlling, regulating and ceasing power for heat generation, such as by controlling electrical current flow from the power source to other components of the article), a heater or heat generation component (e.g., an electrical resistance heating element or component commonly referred to as an "atomizer"), and an aerosol precursor composition (e.g., commonly a liquid capable of yielding an aerosol upon application of sufficient heat, such as ingredients commonly referred to as "smoke juice," "e-liquid" and "e-juice"), and a mouthend region or tip for allowing draw upon the smoking article for aerosol inhalation (e.g., a defined air flow path through the article such that aerosol generated can be withdrawn therefrom upon draw).

Alignment of the components within the article can vary. In specific embodiments, the aerosol precursor composition can be located near an end of the article (e.g., within a cartridge, which in certain circumstances can be replaceable and disposable), which may be proximal to the mouth of a user so as to maximize aerosol delivery to the user. Other configurations, however, are not excluded. Generally, the heating element can be positioned sufficiently near the aerosol precursor composition so that heat from the heating element can volatilize the aerosol precursor (as well as one or more flavorants, medicaments, or the like that may likewise be provided for delivery to a user) and form an aerosol for delivery to the user. When the heating element heats the aerosol precursor composition, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article components can be appreciated upon consideration of the commercially available electronic smoking articles, such as those representative products listed in the background art section of the present disclosure.

A smoking article incorporates a battery or other electrical power source to provide current flow sufficient to provide various functionalities to the article, such as resistive heating, powering of control systems, powering of indicators, and the like. The power source can take on various embodiments. Preferably, the power source is able to deliver sufficient power to rapidly heat the heating member to provide for aerosol formation and power the article through use for the desired duration of time. The power source preferably is sized to fit conveniently within the article so that the article can be easily handled; and additionally, a preferred power source is of a sufficiently light weight to not detract from a desirable smoking experience.

The presently disclosed smoking articles particularly incorporate a heating element that is carbon-based. The carbon-based heater can be predominately formed of carbon (i.e., greater than 50% carbon based on the dry weight of the heater). In specific embodiments, the carbon can comprise about 75% or greater, about 80% or greater, about 90% or greater, about 95% or greater, or about 99% or greater of the dry mass of the heater. The heater thus may be defined by comprising substantially completely carbon. The heater may be defined as consisting essentially of carbon in that the heater does not include any further electrically conductive material. In some embodiments, the carbon-based heater may include a minor content of one or more materials useful in forming the structure of the heater but that do not substantially contribute to electrical conductivity of the heater. For example, a binder material may be included with the carbon material to assist in maintaining the structure of the heater. Preferably, the dry mass of the carbon-based heater is about 75% or greater, about 80% or greater, about 90% or greater, about 95% or greater, or about 99% or greater carbon.

The carbon-based heater is electrically conductive and exhibits a sufficient resistance so as to heat to a temperature effective for vaporization of aerosol precursor materials. In some embodiments, the resistance can be about 0.1 ohms to about 20 ohms, about 0.25 ohms to about 15 ohms, or about 0.5 ohms to about 10 ohms. The resistance of the heater is a function of the resistivity of the material, cross-sectional area, and length. In some embodiments, the porous carbon heater material can exhibit a resistivity of about $1.0\times10^{-3}$ Ω·m to about $1.0\times10^{-4}$ Ω·m. The carbon-based heater also is suitable for heating under application of an electrical current of about 0.1 amps to about 15 amps, about 0.2 amps to about 12 amps, or about 0.25 amps to about 10 amps. Voltage can be about 2V to about 6V, about 2.25V to about 5.5V, or about 2.5V to about 5V. The carbon-based heater can be adapted for heating in a temperature range of about 100° C. to about 600° C., about 150° C. to about 550° C., or about 175° C. to about 500° C.

A carbon heater useful according to various embodiments of the present disclosure may particularly be characterized by the physical nature of the material. As further described below, the carbon-based heater may particularly be a porous carbon material. In various embodiments, porous carbon materials can be particularly useful in the evolution of vapor through heating of a liquid composition. The porous carbon materials specifically can efficiently release liquid materials absorbed therein or adsorbed thereon while simultaneously providing resistive heating at temperature ranges and response times advantageous for use in on-demand aerosolization devices. In some embodiments, the porous carbon material may particularly be a carbon foam. In some exemplary embodiments herein, a carbon foam is specifically described. It is understood, however, that the scope of porous carbon materials is not limited to carbon foam and can in fact encompass any number of porous carbon materials exhibiting properties and functions as described herein.

An illustration of a porous carbon rod 10 that can be useful as a heater according to the present disclosure is shown in FIG. 1. Although the illustrated porous carbon heater is substantially rod shaped, the heater may take on a variety of sizes and shapes. Preferably, the porous carbon heater can be sized and shaped for use in an electronic smoking article. In exemplary embodiments, the porous carbon heater can be elongated and be defined as having a first end and a second, opposing end. The elongated carbon foam heater may have a length of about 5 mm to about 30 mm, about 6 mm to about 20 mm, or about 7 mm to about 15 mm. Depending upon the cross-sectional shape, the elongated porous carbon heater can have a width or diameter of about 0.5 mm to about 7.5 mm, about 0.75 mm to about 7 mm, or about 1 mm to about 5 mm. In an exemplary embodiment, a cylindrical porous carbon rod having a length of about 10 mm and a diameter of about 2 mm can hold up to about 4-8 mg of an aerosol precursor solution (e.g., 85:15:5—glycerol:propylene glycol:water). As further discussed below, the retention capacity of the porous carbon can be increased as desired to increase the amount of aerosol precursor solution that is stored and the number of aerosol puffs that may be formed.

The porous carbon heater can have a density of about 0.005 g/cm$^3$ to about 0.8 g/cm$^3$, about 0.01 g/cm$^3$ to about 0.6 g/cm$^3$, or about 0.05 g/cm$^3$ to about 0.4 g/cm$^3$. The porous carbon heater can have a porosity of about 50% to about 95%, about 60% to about 90%, or about 70% to about 88% based on volume. For example, in one embodiment, the carbon heater can comprise about 13% carbon by volume and 87% air by volume. The porous carbon heater particularly can be defined by its closed cell nature. In other words, the pores or cells in the porous carbon are predominately closed pore (e.g., air filled pores). An illustration of a segment of an ideal, closed pore system is shown in FIG. 2. As seen therein, the individual pores or cells 15 of the porous carbon 10 are defined by interconnected walls 17 that isolate the contents thereof from surrounding pores or cells. An SEM image of a cross-section of an exemplary porous carbon 10 is shown in FIG. 3. The walls 17 of the individual pores or cells 15 are seen in light gray, and the dark portions show the open (non-carbon filled) space between pores or cells. Some of the cell walls include holes 12, and this indicates that the pores or cells 15 of the exemplary porous carbon are less than 100% closed. In the present disclosure, the porous carbon preferably has a closed cell porosity (i.e., percentage of the total volume of pores or cells that are closed) of about 60% or greater, about 75% or greater, about 80% or greater, about 90% or greater, or about 95% or greater. Because of the closed cell structure, the porous carbon can simultaneously have a high porosity and a low liquid retention capacity. In relation to a polar liquid, such as an aerosol precursor composition, the porous carbon heater can have a liquid retention capacity of less than or equal to 100% of the dry mass of the porous carbon heater. If desired, the percentage of closed cells in the porous carbon heater may be reduced to increase the retention capacity thereof. Closed cell porosity can be defined by manufacturer specifications and may be evaluated in relation to liquid permeability, such as using ASTM C577).

The porous carbon useful as a heater according to the present disclosure may be prepared according to any useful method. Exemplary methods of preparing porous carbon materials, such as carbon foam, and the materials produced thereby (which may be useful in a device as presently disclosed herein) are described in U.S. Pat. No. 6,033,506 to Klett, U.S. Pat. No. 6,037,032 to Klett et al., U.S. Pat. No. 6,729,269 to Ott et al., and U.S. Pat. No. 8,372,510 to Miller et al., the disclosures of which are incorporated herein by reference in their entireties.

The porous carbon has been found according to certain embodiments of the present disclosure to be a particularly good electrical conductor and is thus useful as a heater element, such as in an atomizer. In some embodiments, a material for vaporization, such as an aerosol precursor material as otherwise described herein, may be directly applied to the porous carbon heater—e.g., by coating, absorption, adsorption, or the like. In other embodiments, a separate aerosol precursor transport element can be provided. If desired, the aerosol precursor transport element may form a fluid connection between the heater and a secondary liquid storage element (i.e., a liquid reservoir). In preferred embodiments, the aerosol precursor transport element can function simultaneously as a reservoir and a wick. For example, the aerosol precursor transport element can have an initial charge of liquid aerosol precursor composition applied thereto and can also transport liquid composition from the secondary liquid storage element. This can be particularly beneficial to reduce the number of necessary elements in an electronic smoking article or other article incorporating the porous carbon heater. Preferably, the aerosol precursor transport element is arranged so as to be in direct contact with the porous carbon heater. The direct contact can vary. For example, the aerosol precursor transport element may be arranged so as to only contact the porous carbon heater at one or a plurality of discrete points. The aerosol precursor transport element may be arranged so as to at least partially pass through the porous carbon heater axially, perpendicular to the lengthwise axis, at an angle to the lengthwise axis, or any combination thereof. In some embodiments, the aerosol precursor transport element can substantially surround all or a section of the porous carbon heater. Three exemplary arrangements of the aerosol precursor transport element relative to the carbon foam heater are shown in FIG. 4 through FIG. 6.

In the embodiment of FIG. 4, the porous carbon heater 10 is a carbon foam that is combined with an aerosol precursor transport element 20 in the form of a fibrous yarn wick 22 that is soaked with the aerosol precursor material. The yarn wick 22 may be threaded through holes formed in the porous carbon heater 10 and may be wrapped around the porous carbon heater one or a plurality of times.

In the embodiment of FIG. 5, the porous carbon heater 10 is a carbon foam that is combined with an aerosol precursor transport element 20 in the form of a fibrous mass 23 that is partially embedded in a groove formed in the porous carbon heater 10, the fibrous mass being soaked with the aerosol precursor material.

In the embodiment of FIG. 6, the porous carbon heater 10 is a carbon foam that is combined with an aerosol precursor transport element 20 in the form of a capillary. Specifically, a capillary tube 24 is filled with an aerosol precursor material 30 and has an open end in fluid connection with a surface of the porous carbon heater 10. For example, the open end of the capillary tube 24 can be in direct contact with the porous carbon heater 10 or may be spaced apart from the porous carbon heater a distance that allows for movement of the liquid from the capillary tube to the heater. In other embodiments, the open end of the capillary tube 24 may be at least partially embedded in the porous carbon heater 10. As an exemplary embodiment, a capillary made of glass or any other thermally stable material can be used, and the capillary can be partially filled with an aerosol precursor solution. One end of the capillary is closed, and the closed end of the capillary contains an air pocket. The open end of the capillary is in fluid connection with the porous carbon heater as discussed above. The capillary can be either buried inside the substrate or can be outside—e.g., placed parallel to the porous carbon substrate. Initial puffs can be generated using a content of aerosol precursor solution present in the porous carbon. Heat from the porous carbon substrate will expand the air contained in the closed end of the capillary, and the pressure thus generated is effective to force the aerosol precursor solution contained in the capillary on to the porous carbon. Subsequent puffs will be produced by this additional precursor solution.

In further embodiments, an aerosol precursor transport element can be positioned relative a porous carbon heater in even further conformations. For example, an aerosol precursor transport element can substantially surround all or a portion of a porous carbon heater. Alternately, an aerosol precursor transport element can be elongated and be positioned along the length of the porous carbon heater. Moreover, a plurality of individual aerosol precursor transport elements having shapes and formed of materials as otherwise described herein may be positioned relative to the porous carbon heater.

An aerosol precursor transport element useful according to the present disclosure can be formed of a variety of materials as otherwise described herein, such as in relation to wicks and liquid reservoirs. In preferred embodiments, the aerosol precursor transport element combined with a porous carbon heater also is formed predominately of carbon (i.e., greater than 50% of the dry mass of the aerosol precursor transport element comprising carbon). In specific embodiments, about 75% or greater, about 85% or greater, about 90% or greater, or about 95% or greater of the dry mass of the aerosol precursor transport element is carbon. In an exemplary embodiment, the aerosol precursor transport element can be formed of carbon fibers.

A carbon fiber aerosol precursor transport element particularly can be formed of a carbonized fabric. For example, fibrous tow, yarn, or a woven or non-woven fabric formed of natural and/or synthetic fibers may be carbonized through application of high heat so as to substantially drive off all non-carbon components of the materials. Cellulose fibers, in particular, may be useful for forming a carbonized fabric. One method for forming carbonized fabrics is disclosed in U.S. Publ. No. 2009/0011673 to Huang et al., the disclosure of which is incorporated herein by reference in its entirety. Carbonized fabrics that can be used according to the present disclosure are commercially available from Morgan AM&T (Greenville, S.C.).

Carbonized fabrics can be particularly useful as an aerosol precursor transport element, a reservoir, or both according to the present disclosure in light of their open cell porosity. Preferred carbonized fabrics can have an open cell porosity of about 80% or greater, about 85% or greater, or about 90% or greater. Useful carbonized fabrics also can exhibit a great liquid retention capacity. In relation to a polar liquid, such as an aerosol precursor material as described herein, a carbonized fabric aerosol precursor transport element can exhibit a liquid retention capacity of 200% or greater, 400% or greater, or 600% or greater of the dry mass of the carbonized fabric aerosol precursor transport element. As such, the carbonized fabric aerosol precursor transport element can store and rapidly transfer an aerosol precursor material to a porous carbon heater, which can preferentially vaporize the aerosol precursor material. Because of the nature of the porous carbon in some embodiments as discussed above, the porous carbon heater does not significantly absorb the aerosol precursor material from the carbonized fabric. As such, the aerosol precursor material preferentially only is withdrawn from the carbonized fabric aerosol precursor transport element at the point of contact or other fluid connection with the porous carbon heater as the heated porous carbon vaporizes the aerosol precursor material.

An exemplary embodiment of an aerosol precursor transport element 20 in the form of a carbonized fabric 100 is shown in FIG. 7. As seen therein, the carbonized fabric 100 is substantially arc-shaped having an inner arc surface 105 that can be in at least partial contact with the porous carbon heater, as further described below. The carbonized fabric 100 also can have an outer arc surface 110 spaced apart from the inner arc surface 105 and defining a width of the carbonized fabric and a first face 120 spaced apart from an opposing, second face 125 and defining a thickness of the carbonized fabric.

In exemplary embodiments, a carbonized fabric useful according to the disclosure can have a width of about 0.5 mm to about 4 mm, about 1 mm to about 3.75 mm, or about 1.5 mm to about 3.5 mm. The carbonized fabric can have a thickness of about 0.25 mm to about 15 mm, about 0.5 mm to about 12 mm, or about 1 mm to about 10 mm. The carbonized fabric can have a density of about 0.1 g/cm$^3$ to about 0.4 g/cm$^3$, about 0.15 g/cm$^3$ to about 0.35 g/cm$^3$, or about 0.17 g/cm$^3$ to about 0.3 g/cm$^3$.

An image of an exemplary embodiment of a carbonized fabric 100 useful as an aerosol precursor transport element according to the present disclosure is shown in FIG. 8. As seen therein, the carbonized fabric can be formed as a partial disc. While such shape should not be considered as limiting the disclosure, such shape has been found to be particularly efficient for utilizing the significant liquid retention capacity of the carbonized fabric and the relatively small contact surface required for vaporization of a stored aerosol precursor material by the porous carbon. The shape of the aerosol precursor transport element preferably is adapted to minimize the total mass of the aerosol precursor transport element and thus reduce the electrical power necessary to vaporize the aerosol precursor material therefrom. In further embodiments, the carbonized fabric may have a different cross-sectional shape, such as round, triangular, square, star-shaped, or the like. Moreover, the carbonized fabric may be a substantially elongated element. In some embodiments, the carbonized fabric aerosol precursor transport element may be, for example, substantially rod shaped or similarly elongated with a cross-sectional shape other than round.

The fibrous nature of the carbonized fabric useful in certain embodiments of the present disclosure is illustrated in the SEM image provided in FIG. 9. Further images of an exemplary carbonized fabric aerosol precursor transport element are provided in FIG. 10 (showing the carbonized fabric in a dry state), FIG. 11 (showing the carbonized fabric with a liquid aerosol precursor material absorbed therein), and FIG. 12 (showing the carbonized fabric after heating in an exemplary smoking article for twenty puffs of three seconds duration to vaporize a portion of the aerosol precursor material therefrom).

In certain embodiments, a carbonized fabric 100 can be positioned relative a porous carbon heater 10 as shown in FIG. 13. Specifically, the porous carbon heater 10 can have a first end 1020 and an opposing, second end 1025, and the carbonized fabric aerosol precursor transport element 100 can be positioned proximate the first end of the porous carbon heater. Depending upon the actual use of the porous carbon heater, the combined carbonized fabric aerosol precursor transport element may be provided at different positions, may have a different size, and may be present as a plurality of elements. In some embodiments, the combined porous carbon heater and carbonized fabric aerosol precursor transport element can be referred to as an atomizer. Such atomizer may further comprise an electrical connector, which preferably may be non-metallic and, for example, may be formed of graphite. The electrical connector can have a first end in electrical connection with the second end of the porous carbon heater and have a second, opposing end adapted for electrical connection with an electrical power source. Such arrangement is further discussed below.

Further materials useful as conductive substrates may also be utilized according to the present disclosure. For example, conductive substrates as described in U.S. patent application Ser. No. 13/432,406, filed Mar. 28, 2012, may be used, and the disclosure of said patent application is incorporated herein by reference in its entirety.

A heater and an aerosol precursor transport element as substantially described above may be incorporated into a cartridge that is useful as a component of, for example, an electronic smoking article. Beneficially, a cartridge according to the present disclosure can be formed substantially completely of carbon.

In an exemplary embodiment, a cartridge can comprise an elongated, electrically resistive porous carbon heater having a first end and a second, opposing end adapted for electrical connection with an electrical power source. The porous carbon heater can be substantially defined as otherwise described herein. The cartridge also can comprise an aerosol precursor transport element arranged so as to be in direct contact or other fluid connection with the porous carbon heater. In some embodiments, the aerosol precursor transport element can at least partially surround the porous carbon heater. Alternatively, the aerosol precursor transport element can be in a different spatial arrangement with the porous carbon heater and can take on any structure as otherwise described herein. In a preferred embodiment, the aerosol precursor transport element can be formed of carbon fibers, such as a carbonized fabric.

The cartridge further can comprise an electrical connector 300 as illustrated in FIG. 14. The electrical connector 300 can have a first end 320 in electrical connection with the second end 1025 of the porous carbon heater 10 and can have a second, opposing end 325 adapted for electrical connection with the electrical power source. For example, the second end 325 of the electrical connector 300 can be threaded and thus be adapted to screw onto a threaded end of a control body of an electronic smoking article. In further embodiments, the second end 325 of the electrical connector 300 may be adapted for press fit onto a mating end of a control body of an electronic smoking article. Arrangements for such press fit connectors are described in co-pending U.S. patent application Ser. No. 13/840,264, filed Mar. 15, 2013, the disclosure of which is incorporated herein by reference in its entirety. In further embodiments, the second end of the electrical connector may be adapted for electrical connection with a separate connector element, such may be a screw-type connector or a press-fit connector, such as in the above-reference disclosure. In preferred embodiments, the electrical connector can be non-metallic and can, for example, can be formed of graphite.

A cartridge according to the present disclosure further can comprise a housing. One embodiment of a housing is shown in FIG. 15. The housing 400 can substantially surround the further interior components of the cartridge, including the heater, the aerosol precursor transport element, and the electrical connector. Thus, the housing 400 can be described as having a first end 420 proximate the first end of the porous carbon heater and a second end 425 proximate the second end of the electrical connector. The first end 420 of the housing 400 can include one or more openings 440 adapted for passage of vapor or aerosol from the interior of the housing formed by the heating of the porous carbon heater and associated vaporization of the aerosol precursor material stored and/or transported by the aerosol precursor transport element. The housing can be formed of an electrically conductive material. Preferably, the housing is formed of a non-metal. For example, the housing can be formed of graphite.

In some embodiments, the second end of the housing can be adapted for forming a structural connection with a first end of a control body that includes the electrical power source. As such, the housing 400 may include a raised flange 450, and the interior thereof may be adapted form forming a threaded connection or a press fit connection with the control body. In embodiments where the electrical connector facilitates the structural connection with the control body, the flange 450 of the housing 400 may be absent or may function to substantially cover the connection and formed by the electrical connector and the control body. In some embodiments, the housing flange and the second end of the electrical connector may function together to form the structural and/or electrical connection with the control body. In an exemplary embodiment, a housing can have a total length of about 15 mm to about 35 mm, about 18 mm to about 32 mm, or about 20 mm to about 30 mm, a diameter of about 5 mm to about 15 mm, about 6 mm to about 13 mm, or about 7 mm to about 12 mm, and a wall thickness of about 0.1 mm to about 2 mm, about 0.25 nm to about 1.75 mm, or about 0.5 mm to about 1.5 mm. The flange may have a width of about 1 mm to about 8 mm, about 1.5 mm to about 7 mm, or about 2 mm to about 6 mm.

In some embodiments, the housing 400 can be covered with a filter and, optionally, a wrapping element. For example, a hollow tube filter 800 (e.g., formed of cellulose acetate or similar material) can be fitted around the external housing 400 in a manner that creates a flush junction to the raised flange 450 as illustrated in FIG. 16*a*. In an exemplary embodiment, the tube filter can have a total length matching the length of the housing. The hollow tube filter can have a wall thickness of, for example, about 0.5 mm to about 4 mm, about 0.75 mm to about 3.0 mm, or about 1.5 mm to about 2.5 mm. In some embodiments, a full low-efficient (i.e., non-hollow) filter extension 820 may extend beyond the first end of the housing (e.g., by about 5 mm to about 20 mm) thereby allowing for a total length of the housing and filter element (the tube filter 800 in combination with the filter extension 820) to be about 20 mm to about 55 mm. Such embodiment is shown in FIG. 16*b*. Exemplary materials useful for forming such filters include cellulose acetate, regenerated cellulose, polylactic acid, cotton, paper, combinations thereof and the like. In specific embodiments, as illustrated in FIG. 16*c*, wrapping paper or tipping paper, such as used in conventional cigarettes, can be used as an external wrapping layer 840 surrounding the filter element and the outer housing.

In further embodiments, as seen in FIG. 17*a*, the housing 400 can be shortened relative to the embodiment illustrated in FIG. 15, for example. In such embodiments, the housing 400 can be combined with a filter material containing a breakable flavor capsule and, optionally, a wrapping element while maintaining substantially the same diameter as described above. The shortened housing can have a length, for example, of about 5 mm to about 15 mm, about 7 mm to about 13 mm, or about 9 mm to about 11 mm and contain a flange with a width of about 1 mm to about 8 mm, about 1.5 mm to about 7 mm, or about 2 mm to about 6 mm. In certain embodiments, as illustrated in FIG. 17*b*, a hollow tube filter 800 can be fitted around the external housing 400 such that a flush junction is created with the raised flange 450. The tube filter can have a total length matching the length of the housing. A full (non-hollow) filter extension 830 can extend beyond the first end 420 of the housing (e.g., by about 15 mm to about 30 mm) thereby allowing for a total length of the housing and filter element (the tube filter 800 in combination with the filter extension 830) of about 14 mm to about 41 mm. The filter extension 830 is partially transparent in the illustration of FIG. 17*c*. The non-hollow portion of the filter may contain a breakable flavor capsule 835. As illustrated in FIG. 17*c*, the flavor capsule 835 may be substantially centered within the diameter and length of the filter extension 830; however, in further embodiments, the capsule may be off-center in relation to the diameter and/or the length of the filter extension, and a plurality of flavor capsules may be included. The capsule may be adapted to be crushed prior to, during, or after use to release additional flavor elements into the filter material. Exemplary materials of flavor capsule construction and components of flavor capsule payloads that can be adapted for use in the present invention are described, for example, in U.S. Pat. No. 3,390,686 to Irby, Jr. et al; U.S. Pat. No. 4,889,144 to Tateno et al.; U.S. Pat. No. 7,810,507 to Dube et al.; U.S. Pat. No. 7,836,895 to Dube et al; and U.S. Pat. No. 8,066,011 to Clark et al.; U.S. Pat. App. Pub. Nos. 2009/0050163 to Hartmann et al.; 2011/0271968 to Carpenter et al.; and 2013/0085052 to Novak, III et al., the disclosure of which are incorporated herein by reference in their entirety. Other exemplary flavor-imparting elements that may be combined with a device according to the present disclosure are described in U.S. patent application Ser. No. 13/796,725, filed Mar. 13, 2013, the disclosure of which is incorporated herein by reference in its entirety.

In specific embodiments, as illustrated in FIG. 17*d*, wrapping paper or tipping paper, such as used in conventional cigarettes, can be used as an external wrapping layer 840 surrounding the filter element and the outer housing. The external wrapping layer 840 is partially transparent in FIG. 17*d* to show underlying elements.

In further embodiments, the shortened housing can be covered with a hollow tube filter 800 that can extend beyond the end of the housing while maintaining the same diameter as the embodiment illustrated in FIG. 17*b*. In specific embodiments, as illustrated in FIG. 18*a*, the tube filter 800 can be fitted around the external housing such that a flush junction is created with the raised flange 450. The hollow tube filter can have a length of about 10 mm to about 25 mm, about 13 mm to about 22 mm, or about 15 mm to about 19 mm. In addition, a full low-efficient (non-hollow) filter extension 820 can extend beyond the end of hollow tube filter (e.g., by about 5 mm to about 20 mm), thereby enclosing the void space (860 in FIG. 18*a*) between the first end 420 of the housing 400 and the non-hollow filter extension 820 in FIG. 18*b* (with reference also to FIG. 15 and FIG. 17*a*). The total length of the housing 400 and filter element (the tube filter 800 in combination with the filter extension 820) can be about 14 mm to 41 mm. Wrapping paper or tipping paper can be used as an external layer wrapping the hollow and non-hollow filter elements together around housing 400 as a single unit. The wrapping or tipping paper can have a length of 20 mm to 55 mm, 25 to 50 mm, or about 30 mm to 45 mm and cover a circumference of 17 mm to 60 mm, 23 mm to 55 mm, or about 28 mm to 50 mm. In specific embodiments, as illustrated in FIG. 18*c*, wrapping paper or tipping paper, such as used in conventional cigarettes, can be used as an external wrapping layer 840 surrounding the filter element and the outer housing.

The first end 420 of the housing can comprise a wall 410 (which may include the one or more openings for passage of vapor or aerosol). The wall may function to provide a structural connection and/or an electrical connection of the heater to the housing. For example, in the embodiment of a cartridge 600 illustrated in the cross-section of FIG. 19, an alignment recess 445 is present and can be adapted to engage the first end 1020 of the porous carbon heater 10.

Further components of a cartridge according to an embodiment of the present disclosure are also illustrated in FIG. 19. Specifically, the housing 400 can enclose the porous carbon heater 10 and the aerosol precursor transport element 100, as well as the electrical connector 300. In specific embodiments, a sheath 500 may be provided between the housing 400 and one or more of the heater, aerosol precursor transport element, and electrical connector. The sheath can be electrically insulating. Exemplary materials useful for forming a sheath include cork, wood, glass, ceramics, polymeric materials, such as polyether ether ketone (PEEK), and the like. The cartridge 600 also can include a wrapping element 550 that can substantially surround the housing 400. As illustrated in FIG. 19, the wrapping element 550 surrounds the housing 400, including the first end 420 thereof, but the wrapping element stops at the flange 450. The wrapping element can be a fibrous material. In one embodiment, the wrapping element can be a filter material, such as cellulose acetate. See, for example, the embodiments discussed above in relation to FIG. 16*a* through FIG. 18C. In some embodiments, wrapping paper or tipping paper, such as used in conventional cigarettes, may be used and may wrap around a filter material or around the housing itself. Further materials that may be included with the cartridge, such as flavorant-containing fibrous materials, are described in U.S. patent application Ser. No. 13/796,725, filed Mar. 12, 2013, the disclosure of which is incorporated herein by reference in its entirety.

A cartridge as described herein can be particularly advantageous in that the base materials of the cartridge can form the complete electrical circuit. For example, the electrical connector, the porous carbon heater, and the cartridge housing can form an electrical circuit. This is further illustrated in FIG. 20. Specifically, electrical current from a power source passes through the electrical connector 300 and to the porous carbon heater 10, which rapidly heats to a temperature to vaporize aerosol precursor material in the carbon fabric aerosol precursor transport element 100. The electrical current passes from the carbon heater 10 to the front wall 410 of the housing. The electrical current in turn passes through the outer wall 415 of the housing 400 and exits the cartridge 600 through the flange 450. The sheath 500 is illustrated partially cut away, but it may take on a variety of shapes and sizes. As seen in this embodiment, a cartridge according to the present disclosure can be defined as being free of metal. More particularly, the cartridge can be defined in that a majority of the total dry mass all components of the cartridge is carbon, the dry mass referencing all non-liquid components (for example, excluding the liquid aerosol precursor composition). Preferably, the total dry mass of all components of the cartridge can be about 75% or greater, 80% or greater, 85% or greater, 90% or greater, or 95% or greater carbon. An aerosol precursor material as otherwise described herein can be included with the cartridge. In specific embodiments, the aerosol precursor material can be stored in a carbon fabric aerosol precursor transport element and directly delivered from the carbon fabric to the porous carbon heater for vaporization. In alternate embodiments, a further reservoir, such as a fibrous mass or a walled container, may be included, and the carbon fabric may function to transport the aerosol precursor material from the reservoir to the porous carbon heater. Exemplary reservoirs and wicking materials that may be utilized according to the present disclosure are described in U.S. patent application Ser. No. 13/536,438, filed Jun. 28, 2012, U.S. patent application Ser. No. 13/754,324, filed Jan. 30, 2013, and U.S. patent application Ser. No. 13/802,950, filed Mar. 14, 2013, and the disclosures thereof are incorporated herein by reference in their entireties. In still further embodiments, a different material, such as e-glass or c-glass, may be used as an aerosol precursor transport element (e.g., a wick) in combination with or instead of the carbon fabric to transport the aerosol precursor material from the reservoir to the porous carbon heater. In still another embodiment, the alternate aerosol precursor transport element, such as e-glass or c-glass, may function as both a reservoir and a transport element. In one embodiment a cartridge of an electronic smoking article can comprise an electrically resistive heater, an aerosol precursor transport element, and a housing, wherein a majority of the total dry mass all components of the cartridge is carbon.

In some embodiments, a cartridge according to the present disclosure may include a microchip, microcontroller, or like electronic element. For example, electronic components that may be useful are described in U.S. patent application Ser. No. 13/647,000, filed Oct. 8, 2012, and U.S. patent application Ser. No. 13/826,929, filed Mar. 14, 2013, the disclosures of which are incorporated herein by reference in their entireties.

In additional embodiments, the present disclosure can specifically relate to an electronic smoking article. Such smoking article in particular can include a carbon heater as otherwise described herein. Such smoking article in particular can comprise a cartridge as otherwise described herein. In certain embodiments, an electronic smoking article can comprise an electrical power source and an elongated, electrically resistive heater formed of a porous carbon, such as a carbon foam, the porous carbon heater having a first end and a second, opposing end adapted for electrical connection with the electrical power source. The electronic smoking article also can comprise an aerosol precursor transport element, such as a carbon fabric, as otherwise described herein. The electronic smoking article further can comprise an electrical connector, such as a graphite connector, as otherwise described herein. The electronic smoking article additionally can comprise a housing, such as a graphite housing, as otherwise described herein. Still further, the electronic smoking article can include a sheath and/or a housing wrapper as otherwise described herein.

In electronic smoking articles according to the present disclosure, all elements of the device can be present in a single housing. In certain embodiments, the porous carbon heater can be arranged within a cartridge housing and the electrical power source can be arranged within a separate control body housing.

One example embodiment of a smoking article 1000 is provided in FIG. 21. As seen in the cross-section illustrated therein, the smoking article 1000 can comprise a control body 700 and a cartridge 600 that can be permanently or detachably aligned in a functioning relationship. The control body and cartridge may be adapted for engagement via a variety of means, such as a press-fit engagement, interference fit, a magnetic engagement, a threaded engagement, or the like. Components useful in facilitating a press-fit engagement that may be particularly useful according to the present disclosure are described in U.S. patent application Ser. No. 13/840,264, filed Mar. 15, 2013, the disclosure of which is incorporated herein by reference in its entirety.

In specific embodiments, one or both of the control body 700 and the cartridge 600 may be referred to as being disposable or as being reusable. For example, the control body may have a replaceable battery or may be rechargeable and thus may be combined with any type of recharging technology, including connection to a typical electrical outlet, connection to a car charger (i.e., cigarette lighter receptacle), and connection to a computer, such as through a USB cable.

In the exemplified embodiment, the control body 700 includes a control component 706, a flow sensor 708, and a battery 710, which can be variably aligned, and can include a circuit board 712 at a distal end 714 of an external shell 716, the circuit board being useful for inclusion of one or more indicators of function of the device. The indicators can be provided in varying numbers and can take on different shapes and can even be an opening in the body (such as for release of sound when such indicators are present).

A proximal attachment end 722 of the control body 700 can be arranged for attachment to the second end 425 of the cartridge so as to form a structural and/or an electrical connection therewith. A first electrical attachment point 701 is adapted to form an electrical connection with the electrical connector 300, and a second electrical attachment point 702 is adapted to form an electrical connection with the flange 450 of the housing 400 when pressed into the cavity within the flange. The cartridge 600 is arranged as otherwise described herein. In particular, the cartridge 600 includes openings 410 arranged in the front wall 410 of the housing 400 to allow passage of air and entrained vapor (i.e., the components of the aerosol precursor composition in an inhalable form) from the cartridge to a consumer during draw on the smoking article 1000. The smoking article 1000 may be substantially rod-like or substantially tubular shaped or substantially cylindrically shaped in some embodiments. The housing 400 of the cartridge 600 has a first end 420 proximate the first end 1020 of the porous carbon heater 10 and a second end 425 proximate the second end 325 of the electrical connector 300, and the second end of the housing is adapted for forming a structural connection with the proximal attachment end 722 of the control body housing.

The cartridge 600 includes an atomizer comprising the porous carbon heater 10 and the carbon fabric aerosol precursor transport element 100. While the porous carbon is a preferred heater material, non-limiting examples of further materials that may be used as a heater include other tunable conductive/resistive materials, such as Kanthal (FeCrAl), Nichrome, Molybdenum disilicide ($MoSi_2$), molybdenum silicide (MoSi), Molybdenum disilicide doped with Aluminum ($Mo(Si,Al)_2$), and ceramic (e.g., a positive temperature coefficient ceramic). The liquid transport element may also be formed from a variety of materials configured to transport a liquid. For example, the liquid transport element may comprise cotton and/or fiberglass in some embodiments. The control body 700 can include appropriate wiring or circuitry (not illustrated) to form an electrical connection of the battery 710 with the porous carbon heater 10 when the cartridge 600 is connected to the control body 700. When the cartridge 600 is connected to the control body 70, the flange 450 and the electrical connector 350 engage the electrical attachment points 701, 702 on the control body 700 to form an electrical connection such that current controllably flows from the battery 710, through the first electrical contact point 701, to the electrical connector 300, through the porous carbon heater 10, through the housing 400, and to the second electrical connector 702 to form the complete electrical circuit.

In use, when a user draws on the article 1000, the heating element 10 is activated (e.g., such as via a puff sensor), and the components for the aerosol precursor composition are vaporized at the junction between the porous carbon heater 10 and the carbon fabric aerosol precursor transport element 100. Drawing upon the article 1000 causes ambient air to enter the article around the junction between the cartridge 600 and the control body 700 and enter the control body and the cartridge. In the cartridge 600, the drawn air combines with the formed vapor to form an aerosol. The aerosol may be whisked away and pass through the openings 440 in the front wall 410 of the housing 400 of the cartridge. As illustrated, the cartridge 600 also includes an outer wrapper 550 that can be, for example, a filter material, and the aerosol exiting the openings 440 pass through the wrapper for inhalation by a user.

It is understood that a smoking article that can be manufactured according to the present disclosure can encompass a variety of combinations of components useful in forming an electronic smoking article. For example, alternate heaters that may be useful according to the present disclosure are described in U.S. patent application Ser. No. 13/602,871, filed Sep. 4, 2012, the disclosure of which is incorporated herein by reference in its entirety. Further to the above, representative heating elements and materials for use therein are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties. A variable pitch heater that may be useful according to the present disclosure is provided in U.S. patent application Ser. No. 13/827,994, the disclosure of which is incorporated herein by reference in its entirety. Further, a single-use cartridge for use with an electronic smoking article is disclosed in U.S. patent application Ser. No. 13/603,612, filed Sep. 5, 2012, which is incorporated herein by reference in its entirety.

The various components of a smoking article according to the present disclosure can be chosen from components described in the art and commercially available. Examples of batteries that can be used according to the disclosure are described in U.S. Pat. App. Pub. No. 2010/0028766, the disclosure of which is incorporated herein by reference in its entirety.

An exemplary mechanism that can provide puff-actuation capability includes a Model 163PC01D36 silicon sensor, manufactured by the MicroSwitch division of Honeywell, Inc., Freeport, Ill. Further examples of demand-operated electrical switches that may be employed in a heating circuit according to the present disclosure are described in U.S. Pat. No. 4,735,217 to Gerth et al., which is incorporated herein by reference in its entirety. Further description of current regulating circuits and other control components, including microcontrollers that can be useful in the present smoking article, are provided in U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., U.S. Pat. No. 7,040,314 to Nguyen et al., U.S. patent application Ser. No. 13/788,455, filed Mar. 7, 2013, and U.S. patent application Ser. No. 13/837,542, filed Mar. 15, 2013, all of which are incorporated herein by reference in their entireties.

The aerosol precursor material, which may also be referred to as an aerosol precursor composition or a vapor precursor composition, can comprise one or more different components. For example, the aerosol precursor material can include a polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference.

Still further components can be utilized in the smoking article of the present disclosure. For example, U.S. Pat. No. 5,261,424 to Sprinkel, Jr. discloses piezoelectric sensors that can be associated with the mouth-end of a device to detect user lip activity associated with taking a draw and then trigger heating; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. App. Pub. No. 2009/0320863 by Fernando et al. discloses computer interfacing means for smoking devices to facilitate charging and allow computer control of the device; U.S. Pat. App. Pub. No. 2010/0163063 by Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. No. 8,156,944 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon. A variety of the materials disclosed by the foregoing documents may be incorporated into the present devices in various embodiments, and all of the foregoing disclosures are incorporated herein by reference in their entireties.

EXAMPLES

The present invention is more fully illustrated by the following examples, which are set forth to illustrate the present invention and are not to be construed as limiting.

Example 1

A cylindrical rod 3 mm in diameter and 10 mm in length was made from 0.17 g/cm$^3$ carbon foam. Three equally spaced holes about 1 mm in diameter were drilled in the carbon. The holes went through the entire width of the foam. A cotton fiber was threaded through the holes as shown in FIG. 4. An aerosol precursor solution was applied to the fiber-foam assembly. The fiber served as a reservoir for the precursor solution. A current of 4.2 volts and 0.9 amps was passed through the substrate. More than 30 puffs of aerosol were generated.

Example 2

A cylindrical rod of 3 mm in diameter and 10 mm in length was made from 0.17 g/cc carbon foam. A hole of about 1.5 mm in diameter and 1.5 mm in depth was drilled at the center of the carbon foam. A cotton ball saturated with an aerosol precursor solution was inserted in the hole as shown FIG. 5. A current of 4.2 volts and 0.9 amps was passed through the substrate. More than 30 puffs of aerosol were generated.

Example 3

A cylindrical rod 3 mm in diameter and 10 mm in length was made from 0.17 g/cm$^3$ carbon foam. The rod was inserted in the center of a disk formed of carbon fabric having a thickness of about 2 mm and a diameter of about 4 mm. About 0.6 mL of an aerosol precursor solution as applied to the assembly. A current of 4.2 volts and 0.7 amps was applied to the carbon foam heater, and more than 120 puffs of aerosol were generated. An illustration of the exemplary atomizer assembly 2000 formed of the carbon foam heater 2010 and the carbon fabric aerosol precursor transport element 2100 is shown in FIG. 22. Additional exemplary atomizer assemblies are shown in FIG. 23 through FIG. 25. In FIG. 23, the carbon fabric aerosol precursor transport element 2100 is arranged aside the porous carbon heater 2010 along the length thereof. In FIG. 24, two carbon fabric aerosol precursor transport elements 2100*a* and 2100*b* is arranged aside two sides of the porous carbon heater 2010 along the length thereof. In FIG. 25, three carbon fabric aerosol precursor transport elements 2100*c*, 2100*d*, and 2100*e* are provided as discs surrounding the porous carbon heater 2010.

Example 4

An atomizer according to an embodiment of the present disclosure substantially as illustrated in FIG. 13 was prepared using a porous carbon heater formed of carbon foam having a length of about 8.4 mm, a diameter of about 1.4 mm, a resistance of 2.5 amps, and a density of 0.3 g/cm$^3$. A carbon fabric aerosol precursor transport element was used having a thickness of about 2 mm and a width of about 4 mm. Electric current from an approximately 3.7V battery was applied to the carbon foam heater to simulate 20 puffs of approximately three seconds duration each and recorded values were averaged across the 20 puffs. The exemplary atomizer was compared with three commercial electronic cigarettes utilizing a metal wire resistive heater wrapped around a fiberglass wick for transfer of an aerosolization solution. The table below shows the measured total particulate matter (TPM), current, and power output in each test case. As seen, the present carbon/carbon atomizer performed at least as well as known devices utilizing conventional atomizers.

| | Exemplary carbon/ carbon atomizer Puffs 1-20 | Comparative 1 Puffs 1-20 | Comparative 2 Puffs 1-20 | Comparative 3 Puffs 1-20 |
|---|---|---|---|---|
| TPM (mg/puff) | 2.45 | 1.9 | 2.43 | 3.09 |
| Current (amps) | 1.34 | 0.85 | 1.05 | 1.34 |
| Joules/mg TPM | 5.6 | 5.0 | 4.8 | 4.8 |

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An atomizer of an electronic smoking article, the atomizer comprising an electrically resistive heater formed of a porous carbon, wherein a majority of pores in the porous carbon are closed pores, wherein the porous carbon heater is adapted to heat to a temperature of about 150° C. to about 550° C. when subjected to an electrical current of about 0.2 amps to about 12 amps for a time of about 1 second to about 3 seconds.

2. The atomizer of claim 1, wherein the porous carbon comprises about 90% or greater of the dry mass of the electrically resistive heater.

3. The atomizer of claim 1, wherein about 80% or greater by volume of the pores are closed pores.

4. The atomizer of claim 1, wherein the porous carbon heater has a density of about 0.1 $g/cm^3$ to about 0.75 $g/cm^3$.

5. The atomizer of claim 1, wherein the porous carbon heater has an aqueous liquid retention capacity that less than or equal to about 100% of the dry mass of the porous carbon heater.

6. The atomizer of claim 1, further comprising an aerosol precursor material coated on, absorbed by, or adsorbed on the porous carbon heater.

7. The atomizer of claim 1, further comprising an aerosol precursor transport element arranged so as to be in fluid connection with the porous carbon heater.

8. The atomizer of claim 7, wherein the aerosol precursor transport element surrounds the porous carbon heater.

9. The atomizer of claim 7, wherein the aerosol precursor transport element is a fibrous material.

10. The atomizer of claim 7, wherein the aerosol precursor transport element comprises a capillary.

11. The atomizer of claim 7, wherein the aerosol precursor transport element is at least partially embedded within the porous carbon heater.

12. The atomizer of claim 7, wherein the aerosol precursor transport element is formed of carbon fibers.

13. The atomizer of claim 12, wherein about 85% or greater of the dry mass of the carbon fiber aerosol precursor transport element is carbon.

14. The atomizer of claim 12, wherein the carbon fiber aerosol precursor transport element comprises a carbonized fabric.

15. The atomizer of claim 7, wherein the aerosol precursor transport element further comprises an aerosol precursor material.

16. The atomizer of claim 15, wherein the porous carbon heater is elongated having a first end and having a second, opposing end adapted for electrical connection with an electrical power source.

17. The atomizer of claim 16, wherein the aerosol precursor transport element is positioned proximate the first end of the porous carbon heater.

18. The atomizer of claim 16, further comprising an electrical connector having a first end in electrical connection with the second end of the porous carbon heater and having a second, opposing end adapted for electrical connection with the electrical power source.

19. The atomizer of claim 18, wherein the electrical connector is non-metallic.

* * * * *